US008221295B2

(12) United States Patent
Wilkins et al.

(10) Patent No.: US 8,221,295 B2
(45) Date of Patent: Jul. 17, 2012

(54) EXERCISE DEVICE WITH FEATURES FOR SIMULTANEOUSLY WORKING OUT THE UPPER AND LOWER BODY

(75) Inventors: Larry C. Wilkins, Ft. Lauderdale, FL (US); Vaughan Scott, Floyds Knobs, IN (US)

(73) Assignee: Scott & Wilkins Enterprises, LLC, Floyds Knobs, IN (US)

( * ) Notice: Subject to any disclaimer, the term of this patent is extended or adjusted under 35 U.S.C. 154(b) by 71 days.

(21) Appl. No.: 12/756,643

(22) Filed: Apr. 8, 2010

(65) Prior Publication Data

US 2010/0197469 A1 Aug. 5, 2010

Related U.S. Application Data

(63) Continuation of application No. 11/975,813, filed on Oct. 22, 2007, now abandoned.

(60) Provisional application No. 60/853,375, filed on Oct. 20, 2006.

(51) Int. Cl.
*A63B 21/00* (2006.01)
*A63B 21/04* (2006.01)

(52) U.S. Cl. ..... 482/130; 482/138; 482/908

(58) Field of Classification Search ..... 482/135, 482/104, 107, 23, 28–29, 83, 96, 1–9, 51, 482/54, 57, 62, 86–87, 89–92, 121–130, 482/133, 138, 142, 908
See application file for complete search history.

(56) References Cited

U.S. PATENT DOCUMENTS 712,072 A 10/1902 Jordan
750,819 A 2/1904 Cummings
3,428,312 A 2/1969 Machen
3,883,135 A * 5/1975 Milliken ..... 472/69
3,973,772 A * 8/1976 Milliken ..... 482/83
4,082,266 A 4/1978 Elkins
4,099,713 A 7/1978 Spector
4,199,139 A 4/1980 Mahnke et al.
4,492,375 A 1/1985 Connelly
4,534,557 A 8/1985 Bigelow et al.

(Continued)

OTHER PUBLICATIONS

Office Action dated Jul. 14, 2008, in U.S. Appl. No. 11/975,813, filed Oct. 22, 2007.

(Continued)

*Primary Examiner* — LoAn H Thanh
*Assistant Examiner* — Oren Ginsberg
(74) *Attorney, Agent, or Firm* — Finnegan, Henderson, Farabow, Garrett & Dunner, L.L.P.

(57) ABSTRACT

An exercise device, comprising an upper body unit including at least one load member having at least one elastic/resilient element and a pair of gripping portions for manual grasping by the user, wherein an applied force exerted onto the gripping portions transitions the element from an initial state to an elastically deformed state, and wherein a reduction in the applied force resiliently reforms the element back toward the initial state. In one embodiment, a lower body unit is also provided including a support base defining a support surface, a plurality of light sources configured to generate discrete lighted regions on the support surface, and a controller configured to activate and deactivate the discrete lighted regions. In another embodiment, the lower body unit includes at least two position sensors having sensing paths arranged along a sensing plane to detect a presence of a user, and a controller in communication with the position sensors to determine a position of the user relative to the sensing plane.

20 Claims, 18 Drawing Sheets

U.S. PATENT DOCUMENTS 4,544,154 A 10/1985 Ariel
4,635,934 A * 1/1987 Roethke ..... 482/104
4,648,272 A 3/1987 Spector
4,651,987 A 3/1987 Day
4,660,828 A 4/1987 Weiss
4,702,475 A 10/1987 Elstein et al.
4,720,099 A 1/1988 Carlson
4,720,789 A 1/1988 Hector et al.
4,728,100 A 3/1988 Smith
4,743,009 A 5/1988 Beale
4,746,113 A * 5/1988 Kissel ..... 482/99
4,813,665 A 3/1989 Carr
4,907,797 A * 3/1990 Gezari et al. ..... 482/9
4,932,137 A 6/1990 Haley et al.
4,971,305 A * 11/1990 Rennex ..... 482/93
4,986,534 A 1/1991 Meier et al.
5,000,440 A 3/1991 Lynch
5,017,770 A 5/1991 Sigalov
5,072,931 A 12/1991 Carlson
5,104,119 A 4/1992 Lynch
5,120,228 A 6/1992 Stahl et al.
5,121,917 A * 6/1992 Gray ..... 482/81
5,151,071 A 9/1992 Jain et al.
5,162,029 A 11/1992 Gerard
5,171,196 A 12/1992 Lynch
5,234,392 A 8/1993 Clark
5,256,121 A * 10/1993 Brotman ..... 482/93
5,261,864 A 11/1993 Fitzpatrick
5,267,927 A * 12/1993 Catanzano et al. ..... 482/105
5,350,344 A * 9/1994 Kissel ..... 482/98
5,358,461 A 10/1994 Bailey, Jr.
5,362,069 A 11/1994 Hall-Tipping
5,372,564 A 12/1994 Spirito
5,405,152 A 4/1995 Katanics et al.
5,417,636 A 5/1995 Havens
5,417,643 A 5/1995 Taylor
5,469,740 A 11/1995 French et al.
5,512,029 A 4/1996 Barnard et al.
5,520,595 A 5/1996 Lee
5,529,558 A 6/1996 Koenig
5,556,362 A * 9/1996 Whipps ..... 482/98
5,584,779 A 12/1996 Knecht et al.
5,665,031 A 9/1997 Hsieh
5,688,216 A 11/1997 Mauriello
5,888,179 A 3/1999 Singhal
5,899,809 A 5/1999 Landa Cosio
5,921,896 A 7/1999 Boland
5,924,966 A 7/1999 Havlovic
5,964,684 A * 10/1999 Sokol ..... 482/96
5,984,839 A 11/1999 Corkum
6,024,626 A * 2/2000 Mendelsohn ..... 446/92
6,110,073 A 8/2000 Saur et al.
6,312,363 B1 11/2001 Watterson et al.
6,336,891 B1 1/2002 Fedrigon et al.
6,361,481 B1 3/2002 Koenig
6,419,611 B1 7/2002 Levine et al.
6,454,679 B1 9/2002 Radow
6,458,060 B1 10/2002 Watterson et al.
6,464,622 B1 10/2002 Clark
6,561,954 B1 5/2003 Smith
6,575,879 B1 6/2003 Harney et al.
6,592,502 B1 7/2003 Phillips
6,634,994 B2 10/2003 Reid et al.
6,676,569 B1 1/2004 Radow
6,824,502 B1 11/2004 Huang
6,887,190 B1 5/2005 Azari
6,908,417 B2 6/2005 Jackson
6,918,855 B2 * 7/2005 Dumont ..... 482/51
7,011,609 B1 * 3/2006 Kuo ..... 482/94
7,011,611 B1 * 3/2006 Ripley ..... 482/107
7,060,000 B2 6/2006 Carlson
7,060,006 B1 6/2006 Watterson et al.
7,166,062 B1 1/2007 Watterson et al.
7,292,151 B2 11/2007 Ferguson et al.
7,297,089 B2 11/2007 Chen
7,303,508 B2 12/2007 Toyama et al.
7,322,907 B2 1/2008 Bowser
7,329,208 B2 * 2/2008 Yeh ..... 482/54
7,377,883 B1 * 5/2008 Blanton ..... 482/90
7,666,118 B1 * 2/2010 Anthony ..... 482/8
2002/0045519 A1 4/2002 Watterson et al.
2002/0055419 A1 5/2002 Hinnebusch
2004/0192519 A1 * 9/2004 Slawinski ..... 482/99
2004/0259689 A1 12/2004 Wilkins et al.
2005/0009676 A1 1/2005 Turnbull et al.
2005/0245370 A1 11/2005 Boland
2005/0264088 A1 12/2005 Tadin et al.
2006/0142126 A1 6/2006 Wilkins et al.
2006/0194679 A1 8/2006 Hatcher
2006/0281606 A1 12/2006 Radow
2007/0010381 A1 1/2007 Black
2007/0073196 A1 3/2007 Tanaka et al.
2007/0191188 A1 * 8/2007 Collins ..... 482/35
2007/0298883 A1 12/2007 Feldman et al.
2008/0076636 A1 * 3/2008 Smith ..... 482/1
2008/0113852 A1 5/2008 Caldwell
2008/0119333 A1 5/2008 Bowser
2008/0119337 A1 5/2008 Wilkins et al.
2008/0139077 A1 * 6/2008 Patton ..... 446/92
2008/0139975 A1 6/2008 Einav et al.
2008/0161733 A1 7/2008 Einav et al.
2008/0252005 A1 * 10/2008 Pincus ..... 273/150
2008/0312040 A1 12/2008 Ochi et al.
2009/0069161 A1 3/2009 Caldwell
2009/0192022 A1 7/2009 Kulka
2010/0022158 A1 * 1/2010 Kim ..... 446/92

OTHER PUBLICATIONS

Office Action dated Jan. 21, 2009, in U.S. Appl. No. 11/975,813, filed Oct. 22, 2007.

Office Action dated Sep. 10, 2009, in U.S. Appl. No. 11/975,813, filed Oct. 22, 2007.

Office Action dated Jan. 8, 2010, in U.S. Appl. No. 11/975,813, filed Oct. 22, 2007.

* cited by examiner 500a
504
20
404
30
402
500b
400
506
502
28
504
164
162a
506
318
316
336a
510
26
204a
160
214
508
302
202
144a
212
304
24
214
130a
334a
502
204b
334b
330
306
170
162b
130a
314
206
508
144b
144a
310
165
158a
105
166b
120c
200
300
22
336b
130b
168a
168b
100
T
102
P1
169
L
167

104
120b
146
144b
146
158b

EXERCISE DEVICE WITH FEATURES FOR SIMULTANEOUSLY WORKING OUT THE UPPER AND LOWER BODY

CROSS-REFERENCE TO RELATED APPLICATIONS

This application is a continuation of U.S. application Ser. No. 11/975,813, filed Oct. 22, 2007, now abandoned and claims the benefit of priority of U.S. Provisional Application No. 60/853,375, filed Oct. 20, 2006, the disclosures of both of which are incorporated herein by reference in their entirety.

FIELD OF THE INVENTION

The present invention relates generally to the field of exercise devices, and more particularly relates to an exercise device including features for simultaneously working out the upper and lower body.

BACKGROUND OF THE INVENTION

Various types and configurations of exercise devices have been developed to provide the user with an aerobic workout. Such devices include, for example, treadmills, stepping machines, cycling devices, rowing devices, etc. However, an exercise device has not been developed which includes a base unit having a support surface in which discrete portions or regions of the support surface light up to elicit a response or activity (i.e., walking, running, jumping, etc.) to provide a workout of the lower body, and which further includes features that simultaneously provide a workout of the upper body. Additionally, an exercise device has not been developed which provides a realistic simulation of the activity of jumping rope to provide a workout of the lower body, and which further includes features that simultaneously provide a workout of the upper body. Furthermore, an exercise device has not been developed for use in association with activities involving walking, running or jumping to provide a workout of the lower body while providing feedback via a number of position sensors to verify the user's performance of such activities, and which further includes features that simultaneously provide a workout of the upper body.

Thus, there is a general need in the industry to provide an improved exercise device including features for simultaneously working out the upper and lower body. The present invention meets this need and provides other benefits and advantages in a novel and non-obvious manner.

DESCRIPTION OF THE ILLUSTRATED EMBODIMENTS

Figure 1:
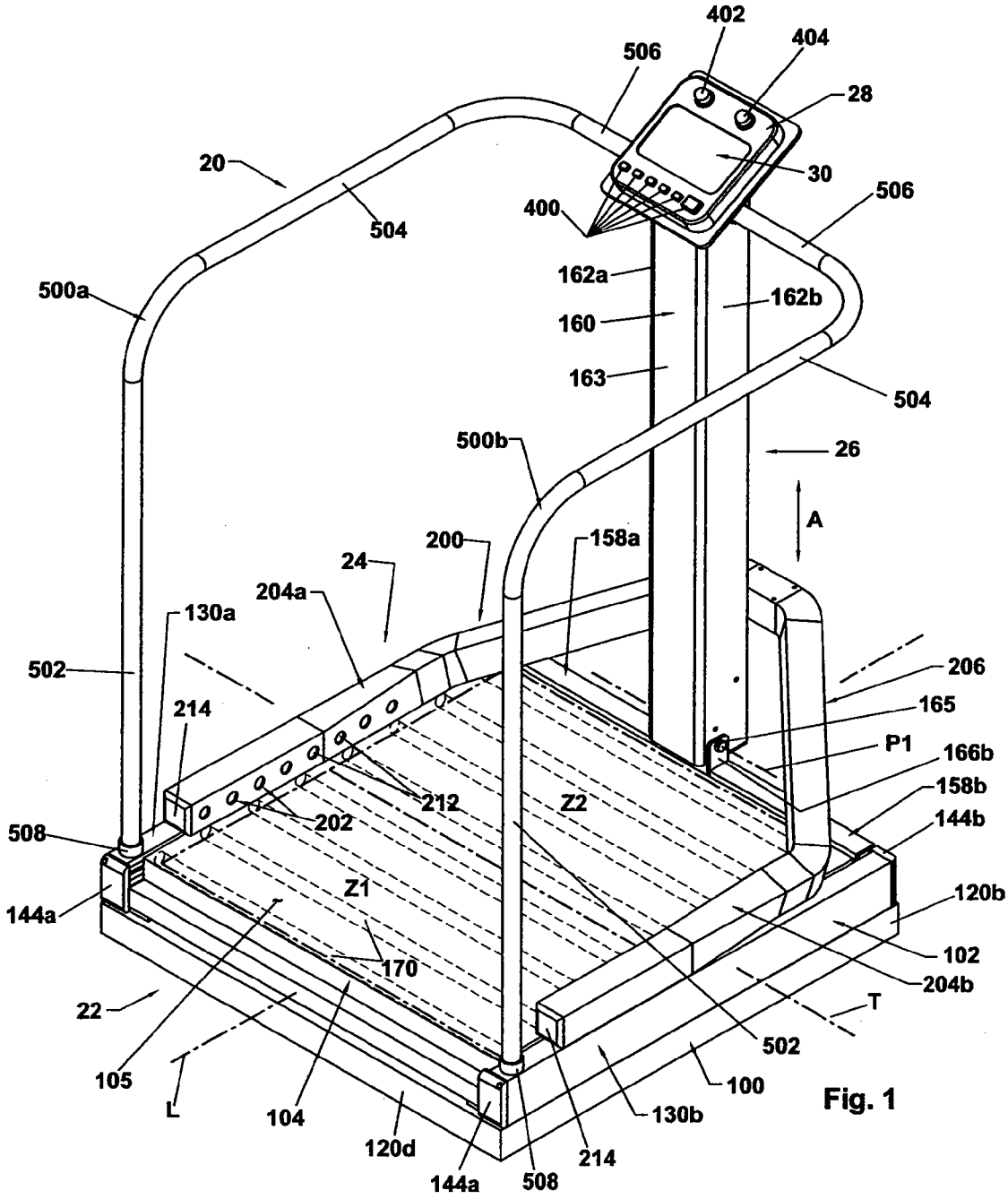
FIG. 1 is a front elevational perspective view of an exercise device according to one form of the present invention.

For the purposes of promoting an understanding of the principles of the invention, reference will now be made to the embodiments illustrated in the drawings and specific language will be used to describe the same. It will nevertheless be understood that no limitation of the scope of the invention is hereby intended, such alterations and further modifications in the illustrated devices, and such further applications of the principles of the invention as illustrated herein being contemplated as would normally occur to one skilled in the art to which the invention relates.

Referring to FIG. 1, shown therein is an exercise device 20 according to one form of the present invention. As will be discussed in greater detail below, the exercise device 20 may be used in association with multiple activities, and is particularly used in association with activities involving jumping, walking or running. For example, in one embodiment of the invention, the exercise device 20 is used to simulate the activity of jumping rope. In another embodiment of the invention, the exercise device 20 is used in association with walking or running in place. In a further embodiment of the invention, the exercise device 20 is used to measure vertical jumping ability and various parameters associated therewith. However, it should be understood that other embodiments of the invention are also contemplated, and that the exercise device 20 may be used in association with activities other than those specifically illustrated and described herein.

In the illustrated embodiment of the invention, the exercise device 20 is generally comprised of a base unit 22, an adjustable position sensor assembly 24, an adjustment mechanism 26, and a control panel 28 including a monitor or display 30. The function of each of these components of the exercise device 20 will now be summarized, followed by a more in-depth discussion regarding the structural configuration and function of each of the components.

The base unit 22 includes a number of light sources or indicators that serve to provide a visual signal or cue to elicit a predetermined response from the user. In one embodiment, the elicited response is a jumping action. However, other elicited responses are also contemplated as falling within the scope of the invention, such as a walking action, a running action, a skipping action, or any other action associated with an exercise activity that would occur to one of skill in the art. The base unit 22 may also be equipped with a number of sensor elements that serve to determine the user's presence upon or absence from the base unit 22.

The adjustable position sensor assembly 24 includes a number of sensor elements that serve to determine whether or not the user's response satisfies a predetermined objective or goal, such as, for example, a predetermined elevation and/or an elapsed period of time. The adjustment mechanism 26 functions to vary the elevation or vertical position of the position sensor assembly 24 relative to the base unit 22 to correspondingly change the predetermined objective or goal of the user.

The control panel 28 controls and monitors operation of the various electrical components associated with the exercise device 20 and may be configured to provide visual and/or audible indications or cues to elicit a user response. The display 30 may also be configured to provide visual indications or cues to elicit a user response, and also serves to provide direct visualization of various parameters that are indicative of the user's performance of a predetermined activity as well as other types of information or data that may be useful to the user.

According to one embodiment of the invention, the base unit 22 is generally comprised of a support frame 100, a light source assembly 102, an upper mat or support pad 104, a support plate 106, and a pressure sensitive pad or strip 108. The components of the base unit 22 are preferably interconnected in such a manner as to form an integral base unit assembly. Additionally, the footprint of the base unit 22 is preferably sized as small as possible while still allowing for unrestrained/uninhibited movement of the user during performance of an exercise activity. Each of the components of the base unit 22 will now be discussed in greater detail.

In one embodiment of the invention, the support frame 100 is formed of a number of support members 120*a*-120*d* that are interconnected to form a substantially rigid framework for providing structural support and rigidity to the base unit 22. In the illustrated embodiment, the support frame 100 includes a pair of side support members 120*a*, 120*b* and front and rear support members 120*c*, 120*d* extending between the side support members 120*a*, 120*b*. The support frame 100 may also include a number of intermediate support members extending between the side support members 120*a*, 120*b* and/or the front and rear support members 120*c*, 120*d* to provide further structural support and rigidity to the base unit 22. In one embodiment of the invention, the support members 120*a*-120*d* are comprised of structural tubing formed of a lightweight material, such as, for example, a metallic material including aluminum or steel, a plastic or polymeric material, a composite material, or any other material that would occur to one of skill in the art. However, it should be understood that other types and configurations of support members and support structures are also contemplated as falling within the scope of the present invention. In a further embodiment of the invention, the base unit 22 may include a number of levelers (not shown) attached to the underside of the support frame 100 to provide a means for leveling the base unit 22, particularly when the base unit 22 is placed on an uneven surface.

In one embodiment of the invention, the light source assembly 102 is generally comprised of a pair mounting rails 130*a*, 130*b* and a plurality of light sources 132. The mounting rails 130*a*, 130*b* are positioned along the sides of the base unit 22, extending generally along the longitudinal axis L and secured to the side support frame members 120*a*, 120*b*, respectively. The light sources 132 are mounted to each of the mounting rails 130*a*, 130*b* and are disposed at intermittent locations along the longitudinal axis L. As will discussed in greater detail below, the light sources 132 are capable of illuminating discrete portions or bands of the base unit 22, and more particularly the upper support pad 104, to elicit a predetermined response from the user. It should be understood, however, that the light sources may be adapted to provide other types and configurations of illuminated areas or regions of the base unit 22.

Figure 6:
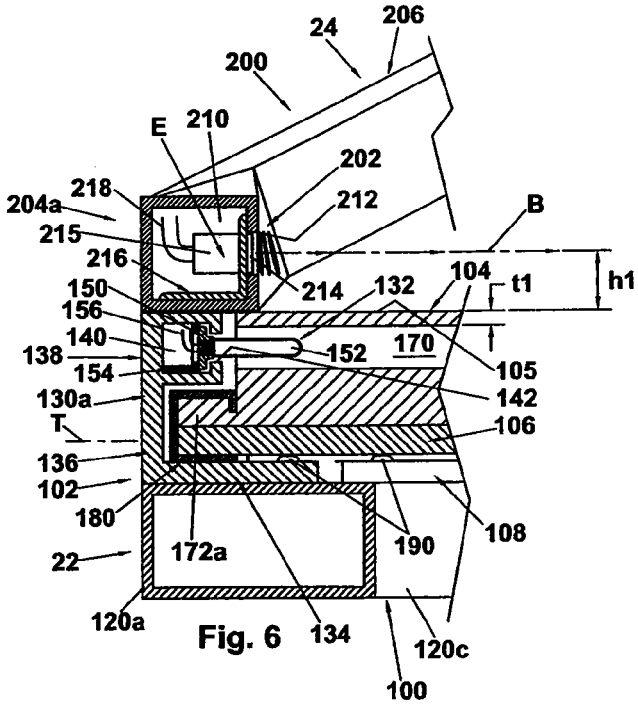
FIG. 6 is an enlarged cross sectional view of a portion of the base unit illustrated in FIG. 5.

Each of the mounting rails 130*a*, 130*b* is configured substantially identical to one another. Accordingly, only the mounting rail 130*a* will be described in detail, it being understood that the mounting rails 130*b* is configured substantially identical to mounting rail 130*a*. Referring specifically to FIG. 6, according to one embodiment of the invention, the mounting rail 130*a* includes a base portion 134 secured to the upper surface of the support frame member 120*a*, a leg portion 136 extending upwardly from the base portion 134, and a housing portion 138 positioned adjacent the end of the leg portion 136. The housing portion 138 defines a hollow interior region 140. A number of light source openings or apertures 142 are formed through a side wall of the housing portion 138 facing the inner area of the base unit 22. A pair of removable end caps or covers 144*a*, 144*b* (FIGS. 1 and 2) are preferably secured to opposite ends of each support rail 130*a*, 130*b* by a number of fasteners 146 (FIG. 2) to close off the ends of the support rails 130*a*, 130*b*, and more particularly the interior regions 140 of the housing portions 138.

In one embodiment of the invention, the light sources 132 are comprised of candescent or incandescent lights, with each light having a base portion 150 and an illumination or bulb portion 152. However, it should be understood that other types and configurations of light sources 132 are also contemplated as falling within the scope of the present invention, such as, for example, a fiber-optic light source, a fluorescent light source, a laser light source, an LED light source, an infrared light source, or any other type of light source that would occur to one of skill in the art. It should be appreciated that any light source that is capable of generating a visual indication, signal or cue to elicit a response from the user is contemplated for use in association with the present invention. It should further be appreciated that the light source may additionally be configured to provide non-visual indications, signals or cues to elicit a response from the user. It should also be understood that although the light sources 132 are illustrated and described as having a bulbous configuration, other configurations are also contemplated, such as, for example, a tubular configuration or filament configuration extending laterally across the base unit 22.

As most clearly shown in FIG. 6, the base portions 150 of the light sources 132 are positioned within the interior region 140 of the housing 138, with the bulb portions 152 extending through respective ones of the light source apertures 142. In one embodiment of the invention, the lights 132 associated with the mounting rails 130*a*, 130*b* are arranged in opposing pairs that are generally aligned across from one another. The base portions 150 of the lights 132 are secured to a mounting bracket 154 which is in turn engaged within the interior region 140 of the housing 138 to securely mount the lights 132 to the support rail 130*a*. Electrical leads 156 extend from each of the lights 132 and run through the interior region 140 of the housing 138 toward the front of the base unit 22. The leads 156 may be routed through laterally-extending tubular members 158*a*, 158*b* arranged at the front ends of the support rails 130*a*, 130*b* and up through the interior region of a vertical support column 160 to the control panel 28 (see FIG. 2). The control panel 28 functions to turn the lights 132 on and off at select time intervals, the details of which will be discussed below.

Figure 10:
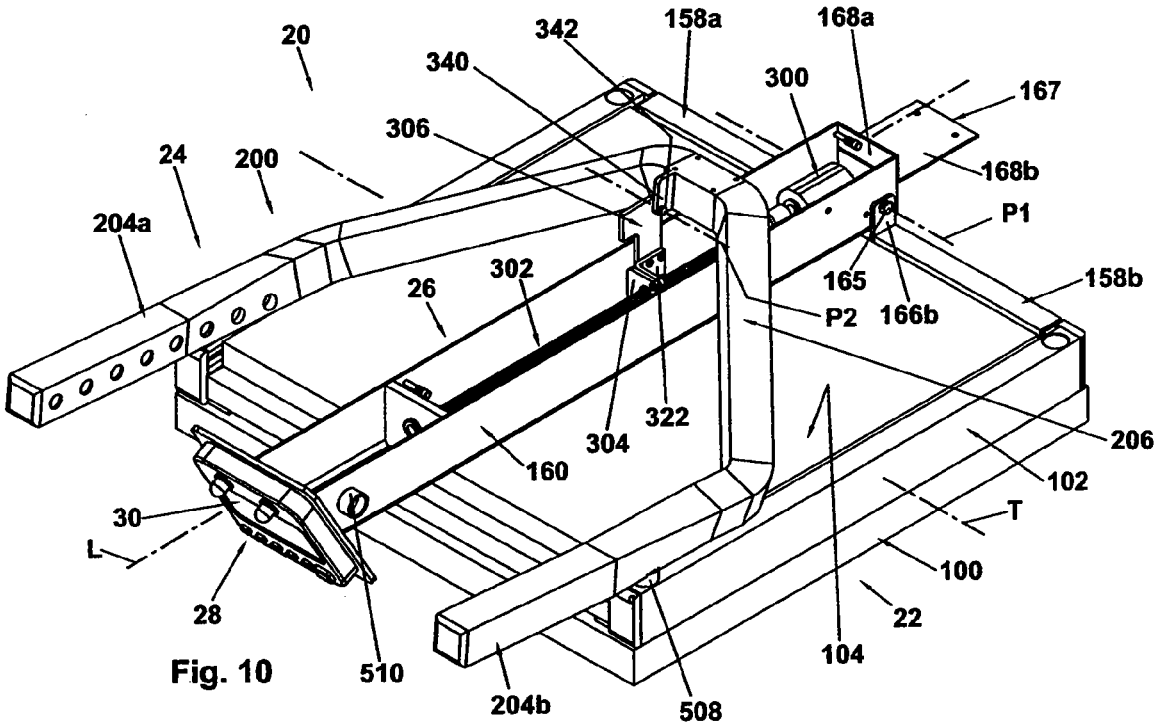
FIG. 10 is a front elevational perspective view of the exercise device illustrated in FIG. 1, as shown in a folded configuration adapted for transport or storage.

In one embodiment of the invention, the vertical support column 160 is generally comprised of a pair of side walls 162*a*, 162*b* and a front wall 163 defining a hollow interior region 164. A removable rear cover (not shown) may also be provided to enclose the interior region 164 and the working components of the adjustment mechanism 26. The vertical support column 160 is pivotally mounted to the base unit 22 via a pivot pin 165 passing between a pair of opposing yoke plates 166*a*, 166*b* (FIG. 5) extending upwardly from the laterally-extending tubular members 158*a*, 158*b*. In this manner, the vertical support column 160 is permitted to pivot about a pivot axis $P_1$ between a substantially vertical operational position (FIG. 1) and a substantially horizontal storage or transport position (FIG. 10).

Figure 2:
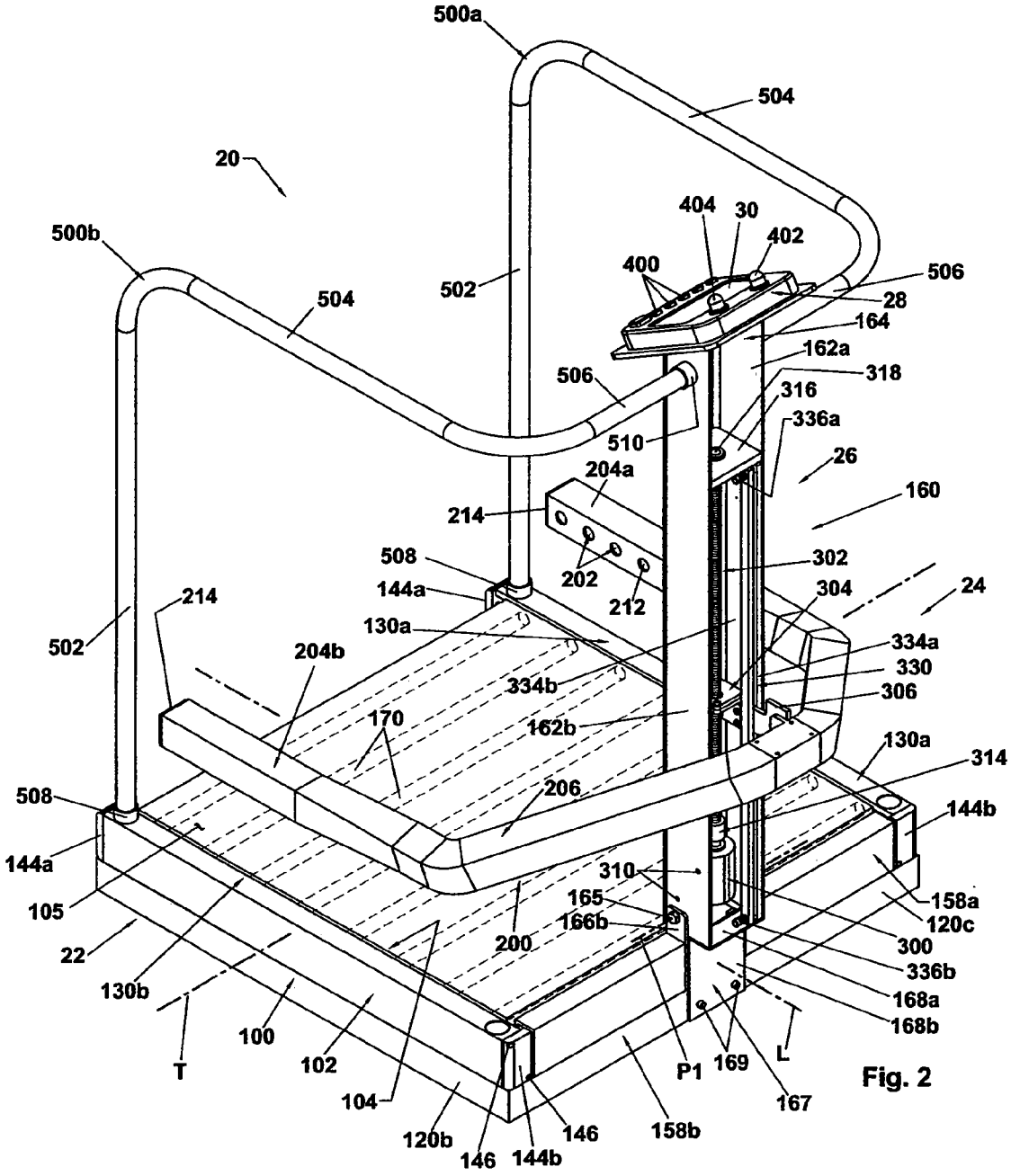
FIG. 2 is a rear elevational perspective view of the exercise device illustrated in FIG. 1.

The vertical support column 160 is selectively maintained in the vertical operational position via a bracket 167 having a flange plate portion 168*a* secured to the lower ends of the column side walls 162*a*, 162*b* and a base plate portion 168*b* that is selectively attached to the front frame support member 120*c* via a number of fasteners 169 (FIG. 2). However, other means for selectively maintaining the vertical column 160 in the vertical operational position are also contemplated as falling within the scope of the present invention. As should be appreciated, pivoting the support column 160 to the collapsed configuration illustrated in FIG. 10 provides for a more compact, lower profile configuration to facilitate transport of the exercise device 20 and/or storage of the exercise device 20 in areas having limited space, such as, for example, under a bed or in a closet.

In one embodiment of the invention, the upper support pad 104 defines an upper support surface 105 and is preferably formed of a resilient, shock-absorbing material that is strong enough to support the dynamic weight of the user during an activity such as jumping, running, walking, etc., while still providing a certain degree of give or flexible resilience to reduce the likelihood of a stress-related injury. Although the support pad 104 and the upper support surface 105 have been illustrated and described as having a generally flat, planar configuration, it should be understood that other configurations are also contemplated, including curved or angled configurations. The support pad 104 may be formed of a non-slip material to reduce the likelihood of user injury. Alternatively, the upper support surface 105 of the support pad 104 may be treated to provide a non-slip surface, such as, for example, by roughening the upper support surface 105 and/or by applying a non-slip material or coating to the upper support surface 105. In a preferred embodiment of the invention, the support pad 104 is formed of a transparent, translucent, semi-translucent or semi-opaque material that is capable of allowing for the transmission of an amount of light therethrough, the purpose of which will become apparent below. In a specific embodiment of the invention, the upper pad 104 is formed of a urethane material. However, other materials are also contemplated for use in association with the present invention, including various types of plastic materials, polymeric materials, or rubber materials.

Figure 5:
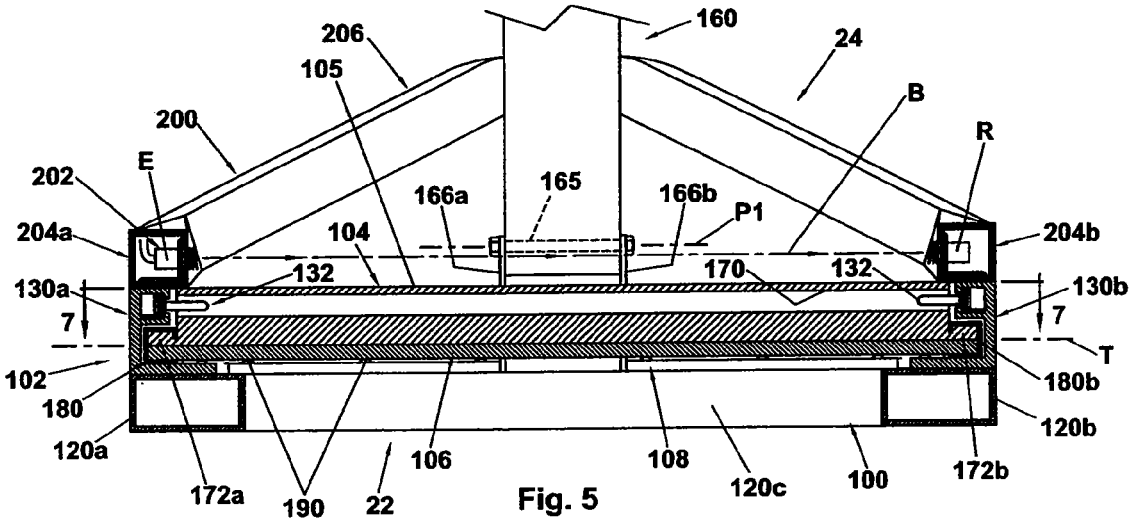
FIG. 5 is a cross sectional view of the base unit and sensor assembly of the exercise device illustrated in FIG. 4, as taken along line 5-5 of FIG. 4.
Figure 7:
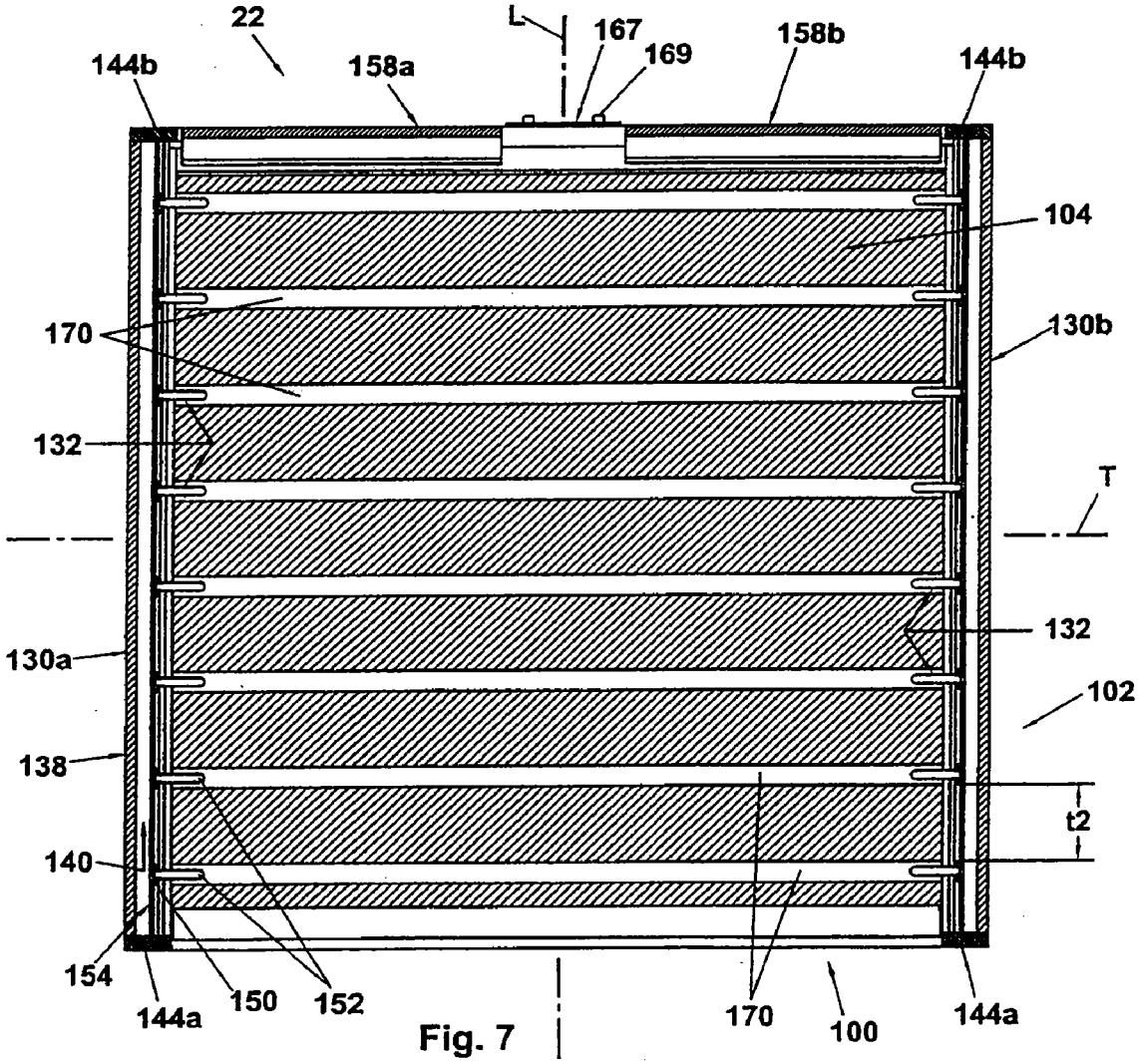
FIG. 7 is a cross sectional view of the base unit illustrated in FIG. 5, as taken along line 7-7 of FIG. 5.

As illustrated in FIGS. 5-7, a number of channels or openings 170 are formed through the support pad 104, extending laterally across the base unit 22. The support pad 104 also includes a pair of mounting flange portions 172*a*, 172*b* extending laterally from opposite sides of the support pad 104 and running substantially the entire length thereof, the purpose of which will be discussed below. In one embodiment of the invention, the channels 170 have a substantially circular cross section and are generally aligned with opposing pairs of the lights 132 such that activation of an opposing pair of the lights 132 will illuminate the region of the support pad 104 adjacent the corresponding light channel 170. The light channels 170 are preferably sized and positioned such that the thickness of material $t_1$ (FIG. 6) directly above the light channels 170 is significantly less than the thickness of material $t_2$ (FIG. 7) between adjacent ones of the light channels 170. In this manner, a majority of the light emitted by the lights 132 will be transmitted in an upward direction to illuminate the region of the support pad 104 above the corresponding light channel 170. Although a specific size, shape and configuration of the light channels 170 has been illustrated and described herein, it should be understood that other sizes, shapes and configurations of the light channels 170 are also contemplated as falling within the scope of the present invention.

Figure 8:
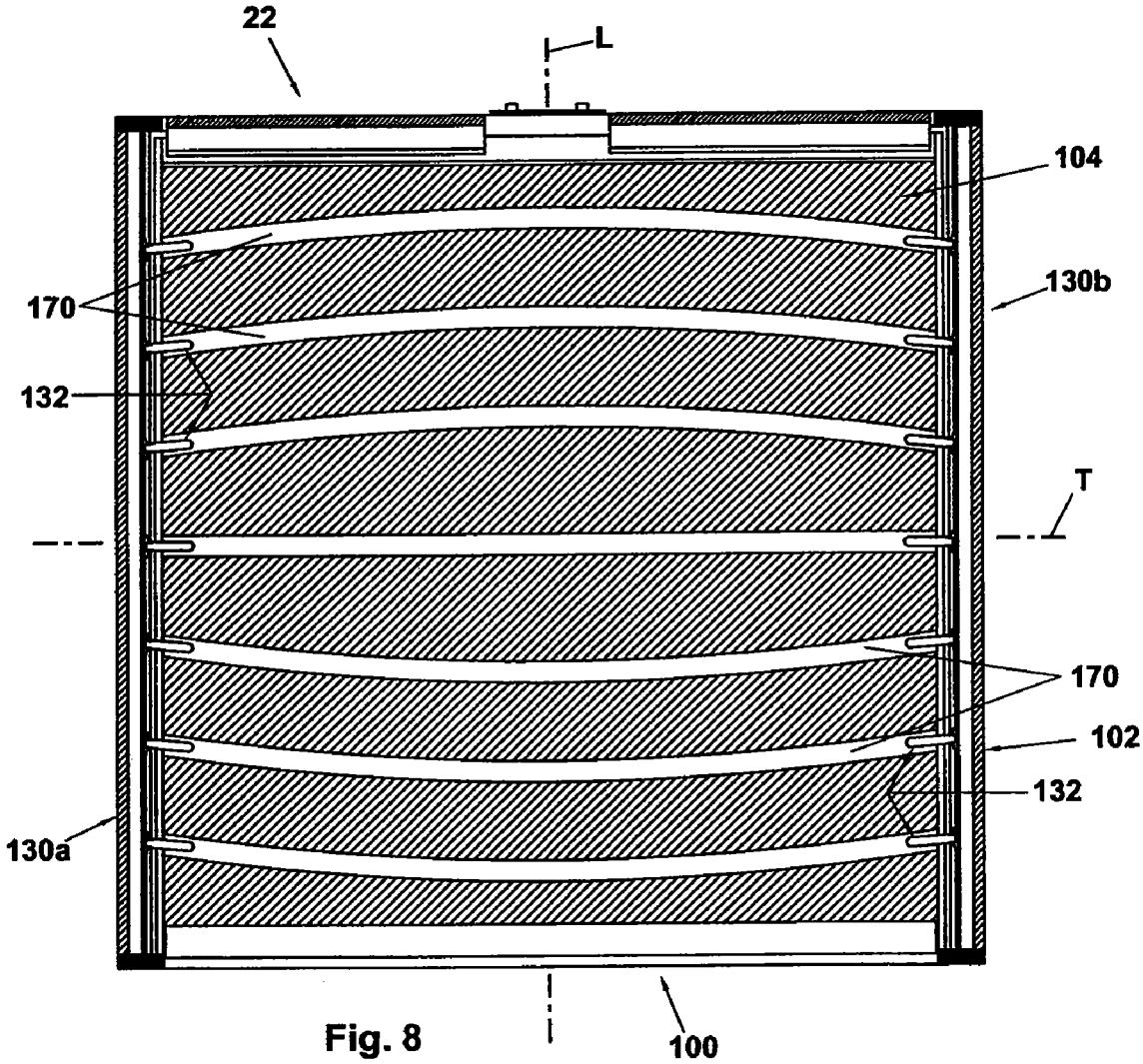
FIG. 8 is a cross sectional view of an alternative embodiment of the base unit illustrated in FIGS. 5 and 7.

In the illustrated embodiment of the invention, the light channels or lights bands 170 extend laterally across the base unit 22 and are generally aligned with the transverse axis T. However, it should be understood that in other embodiments of the invention, the light channels 170 may alternatively extend along the longitudinal axis L or in directions oblique to the transverse axis T. Furthermore, although the light channels 170 are illustrated as having a substantially linear configuration, it should be understood that in other embodiments of the invention, some or all of the light channels 170 may take on a non-linear configuration, such as, for example, an arcuate or curved configuration or a polygonal configuration. One such embodiment is illustrated in FIG. 8 wherein the light channels 170' positioned toward the front and rear of the base unit 22 have varying degrees of lateral curvature, the purpose of which will be discussed below. Additionally, although the light channels 170 are illustrated as being offset from one another by a substantially uniform distance, it should be understood that in other embodiments of the invention, the distance between the light channels 170 may be varied. Moreover, although the base unit 22 is illustrated as having eight (8) light channels 170, it should be understood that any number of light channels 170 may be used, including a single light channel 170.

In one embodiment of the invention, the support plate 106 is formed of a relatively rigid material, such as, for example, an aluminum material or a composite material. However, it should be understood that the support plate 106 may be formed of other materials as would occur to one of skill in the art, such as, for example, a plastic material or a polymeric material. The support plate 106 is positioned beneath the support pad 104 and is coupled thereto by a number of clip members 180 that extend about the lateral end portions of the support plate 106 and engage the mounting flange portions 172*a*, 172*b* of the support pad 104. The clip members 180 are in turn secured to the base portions 134 of the mounting rails

130*a*, 130*b* to engage the support pad 104 and the support plate 106 to the support frame 100.

In one embodiment of the invention, the pressure sensitive pad or strip 108 is formed of a relatively rigid material, such as, for example, an aluminum material or a composite material. However, the pressure sensitive pad 108 (FIGS. 5 and 6) may also be formed of other materials as would occur to one of skill in the art, such as, for example, a plastic material or a polymeric material.

Referring to FIGS. 5 and 6, the pressure sensitive pad or strip 108 is positioned beneath the support plate 106 and is engaged to the support frame 100. A plurality of pressure sensors 190 are positioned along the upper surface of the pressure sensitive pad or strip 108 proximately adjacent the lower surface of support plate 106. A number of pressure sensors 190 may also be positioned between the support plate 106 and the base portion 134 of the mounting rails 130*a*, 130*b* and/or at other locations along the support plate 106. The pressure sensors 190 are electrically connected to the control panel 28. As should be appreciated, when the user stands upon the support pad 104, the weight of the user will slightly displace the support plate 106, thereby actuating one or more of the pressure sensor 190. The pressure sensors 190 in turn provide a signal to the control panel 28 to indicate the presence or absence of the user upon the support pad 104. Although a specific type and configuration of the pressure sensor 190 has been illustrated and described herein, it should be understood that other types and configurations of pressure sensors are also contemplated for use in association with the present invention as would occur to one of skill in the art.

Figure 4:
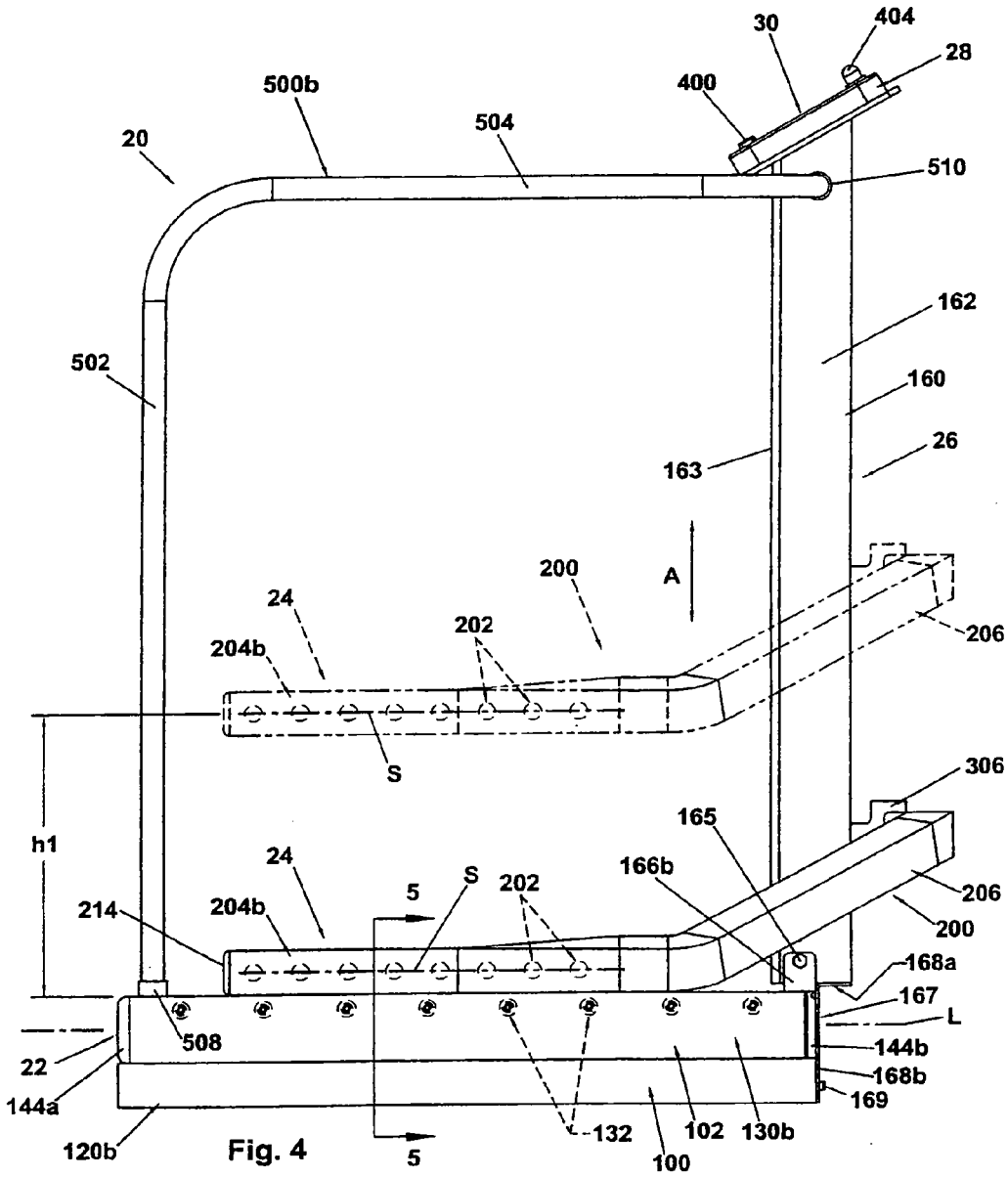
FIG. 4 is a side elevational view of the exercise device illustrated in FIG. 1.

According to one embodiment of the invention, the adjustable position sensor assembly 24 is generally comprised of a mounting structure 200 and a plurality of position sensors 202 mounted to the mounting structure 200. As illustrated in FIG. 4, the position sensors 202 are preferably arranged along a sensing plane S located above the upper surface 105 of the support pad 104 so as to detect the presence of the user along the sensing plane S. In a preferred embodiment of the invention, the sensing plane S is arranged substantially parallel with the upper surface 105 of the support pad 104. However, it should be understood that the sensing plane S may be arranged at an oblique angle relative to the support surface 105. Additionally, although the sensing plane S has been illustrated and described as having a generally flat or linear configuration, it should be understood that the sensing plane S may take on other configurations, such as, for example, a polygonal configuration or an arcuate or rounded configuration.

In the illustrated embodiment of the invention, the position sensor assembly 24 is comprised of a plurality of position sensors 202 positioned to define a single sensing plane S located above the upper surface 105 of the support pad 104 so as to detect the presence of the user along the sensing plane S. However, it should be understood that in other embodiments of the invention, the position sensor assembly 24 may include a plurality of position sensors 202 arranged so as to define multiple sensing planes S positioned at predetermined vertical intervals relative to one another. In this manner, the vertical adjustability feature of the position sensor assembly 24 may be eliminated if desired, relying instead upon the sensing of the presence and/or absence of the user along the multiple sensing planes S to correspondingly measure the vertical position of the user relative to the upper surface 105 of the support pad 104. In a further embodiment of the invention, the position sensor assembly 24 may include a plurality of position sensors 202 arranged so as to define one or more sensing planes S extending in a substantially vertical orientation to measure the position of the user relative to the upper surface 105 of the support pad 104.

In one embodiment of the invention, the mounting structure 200 includes a pair of mounting arms or bars 204*a*, 204*b* disposed along respective sides of the base unit 22. The mounting arms 204*a*, 204*b* preferably extend generally along the longitudinal axis L and are preferably positioned generally above the light source mounting rails 130*a*, 130*b*. However, other orientations and positions of the mounting arms 204*a*, 204*b* are also contemplated as falling within the scope of the present invention. The mounting arms 204*a*, 204*b* are interconnected to one another via a generally V-shaped or U-shaped base portion 206 which is in turn coupled to the vertical support column 160, the details of which will be discussed below. The position sensors 202 are mounted to and are disposed at intermittent axial locations along the mounting arms 204*a*, 204*b*.

The mounting arms 204*a*, 204*b* are configured substantially identical to one another. Referring to FIGS. 5 and 6, in one embodiment of the invention, the mounting arms 204*a*, 204*b* have a tubular configuration defining a hollow interior region 210. A number of sensor openings or apertures 212 (FIG. 6) are formed through a side wall of each of the mounting arms 204*a*, 204*b* facing the inner area of the base unit 22. A removable end cap or cover 214 (FIG. 1) is preferably positioned over the open end of each mounting arm 204*a*, 204*b* to close off the interior region 210 from the outer environment.

In one embodiment of the invention, the position sensors 202 are of the photoelectric type, with each position sensor 202 including an emitter unit E and a receiver unit R. As shown in FIGS. 5 and 6, the emitter and receiver units E, R are positioned within the interior regions 210 of the mounting arms 204*a*, 204*b*, with the emitting and receiving portions 214 of the units E, R generally aligned with respective ones of the sensor apertures 212. The base portions 215 of the units E, R are secured to a mounting bracket 216 which is in turn engaged within the interior region 210 of the mounting arms 204*a*, 204*b* to securely mount the sensors 202 to the mounting structure 200. Electrical leads 218 extend from each of the emitter and receiver units E, R and are run through the interior regions 210 of the mounting arms 204*a*, 204*b*, through the interior region of the base portion 206, and up along the vertical support column 160 to the control panel 28.

As should be appreciated, the emitter units E each emit a light beam B that is received or sensed by a corresponding receiver unit R, with each of the light beams B extending generally along the sensing plane S. As should also be appreciated, the emitter and receiver units E, R are arranged in opposing pairs, with an emitter unit E mounted to one of the mounting arms (e.g., 204*a*) and positioned in generally alignment with a corresponding receiver unit R mounted to the opposite mounting arm (e.g., 204*b*). When there is no obstruction present between the emitter unit E and the receiver unit R, the light beam B will remain unbroken and the receiver unit R will communicate a signal to the control panel 28 indicating an uninterrupted condition. However, when the light beam B is broken by an obstruction (e.g., by the user's foot or leg) the receiver unit R will communicate a signal to the control panel 28 indicating an interrupted condition. Accordingly, the position sensors 202 are capable of detecting the presence or absence of the user along the sensing plane S, and hence the position of the user relative to the base unit 22.

As will be discussed below, the height $h_1$ or elevation of the sensor assembly 24 and the position sensors 202 may be varied relative to the support surface 105 of the support pad 104 (FIG. 4) via the adjusting mechanism 26 to correspondingly adjust the height of the sensing plane S relative to the upper support surface 105. The adjustment mechanism 26 is preferably configured to provide approximately thirty-six (36) inches of vertical adjustment to the sensor assembly 24. In one embodiment of the invention, the light beams B are visible to provide the user with a visual indication as to the selected height $h_1$ of the position sensors 202 and the sensing plane S. Laser-type emitters E that emit a relatively intense/bright beam of light B are particularly suitable for visualization by the user; however, other types of emitters E are also contemplated as would occur to one of skill in the art. In order to provide enhanced visualization of the light beams B, the ambient lighting may be turned down and/or fog, smoke or another type of air-borne substance or material may be provided. Additionally, although the light beams B are illustrated as being linear, it should be understood that in other embodiments of the invention, the sensors 202 may be configured and arranged such that the light beams B are non-linear (e.g., curvilinear or angled).

In one embodiment of the invention, the number of position sensors 202 associated with the sensor assembly 24 corresponds to the number of the light channels 170 in the base unit 22. In the illustrated embodiment, the sensor assembly 24 includes eight (8) position sensors 202 corresponding to the eight (8) light channels 170 in the base unit 22. However, it should be understood that any number of position sensors 202 may be used, including a single position sensor 202, a pair of position sensors 202, or any other number of position sensors 202. It should also be understood that the number of position sensors 202 need not necessarily correspond to the number of light channels 170. Additionally, the position sensors 202 need not necessarily be aligned directly above a corresponding light channel 170, and need not necessarily be offset from one another by a uniform distance.

Figure 3:
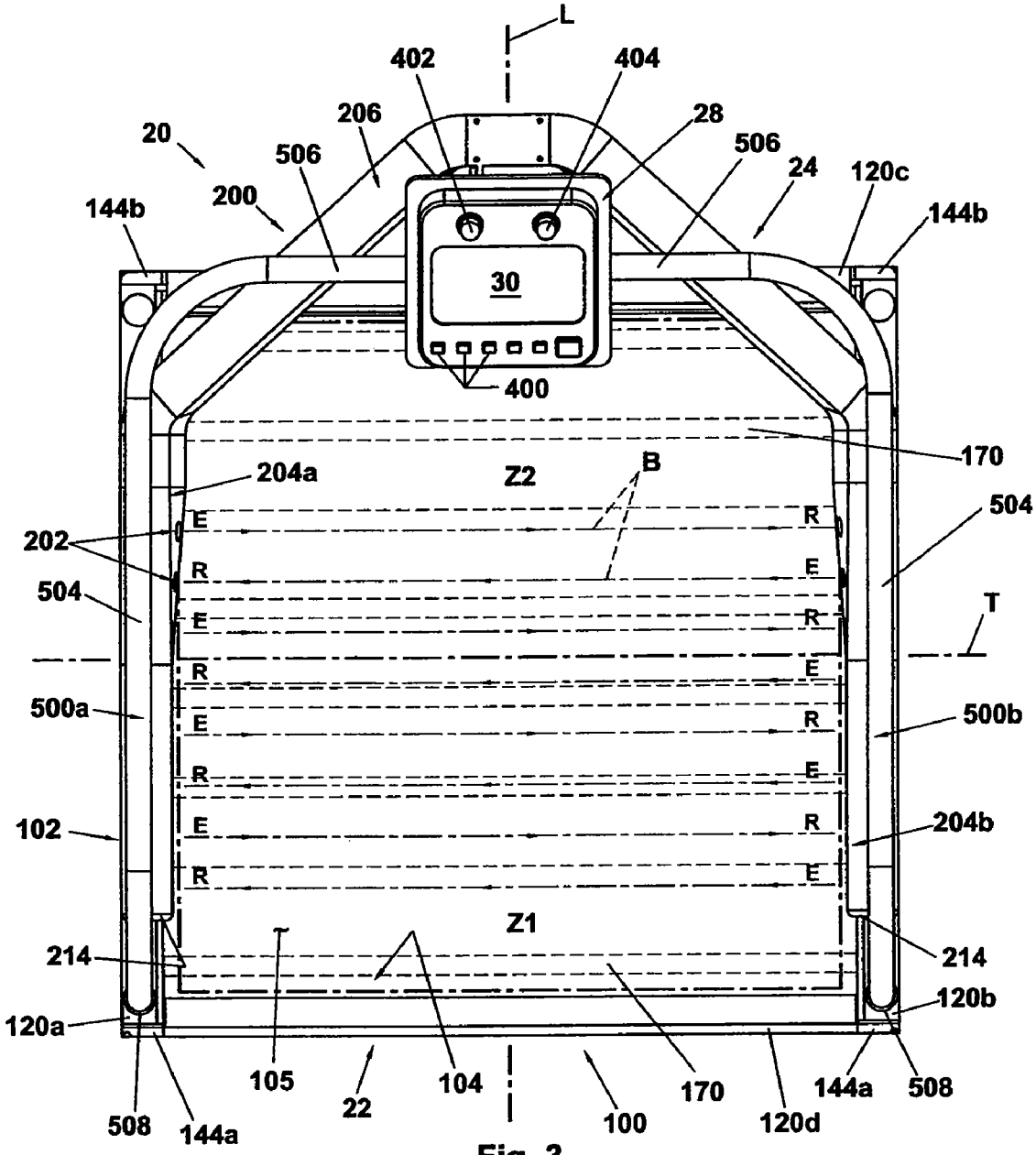
FIG. 3 is a top plan view of the exercise device illustrated in FIG. 1.

As illustrated in FIG. 3, the opposing pairs of the emitter and receiver units E, R are preferably arranged in a staggered or alternating configuration such that the receiver units R are separated from another by an intermediate emitter unit E. As a result, the likelihood that a receiver unit R will erroneously detect the light beam B emitted from the wrong emitter unit E is reduced. However, it should be understood that other configurations are also contemplated, including configurations where all of the emitter units E are mounted to one of the mounting arms (e.g., 204*a*) and all the receiver units R are mounted to the opposite mounting arm (e.g., 204*b*).

Although the position sensors 202 have been illustrated and described as photoelectric-type sensors, with each position sensor 202 including an emitter unit E and a receiver unit R, it should be understood that other types and configurations of position sensors are also contemplate as falling within the scope of the present invention. For example, instead of having separate emitter and receiver units E and R, in other embodiments of the invention, the emitter and receiver elements may be integrated into a single unit. In this alternative embodiment, the integrated emitter/receiver unit would be mounted to one of the mounting arms (e.g., 204*a*), with an optical reflector mounted to the other mounting arm (e.g., 204*b*) and positioned in generally alignment with the integrated emitter/receiver unit. As should be appreciated, the emitter portion of the integrated unit would emit a light beam that is reflected off of the optical reflector and back to the receiver portion of the integrated unit. Additionally, in lieu of photoelectric-type sensors, the sensor assembly 24 may include other types of position sensors, including various types and configurations of laser sensors, fiber optic sensors, optical sensors, motion sensors, infrared sensors, thermal sensors, ultrasonic sensors, capacitive sensors, proximity sensors, or any other type of position sensor that would occur to one of skill in the art.

Figure 9:
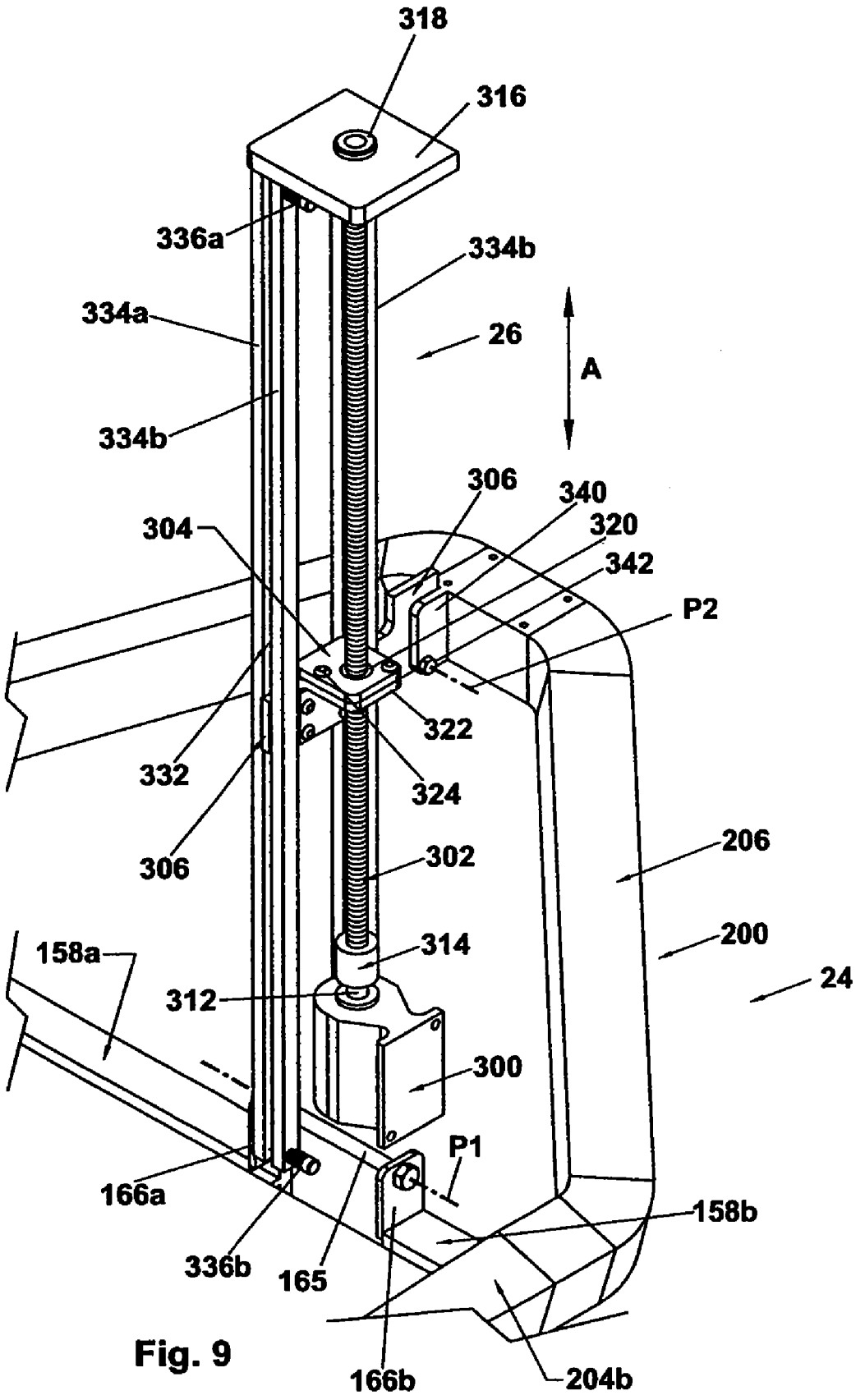
FIG. 9 is a front elevational perspective view of an adjustment mechanism for use in association with the exercise device illustrated in FIG. 1 to vary the elevation of the sensor assembly.

Referring to FIG. 9, according to one embodiment of the invention, the adjustment mechanism 26 is generally comprised of an actuator or electric drive motor 300, a threaded drive shaft or screw 302, and a threaded drive plate or nut 304 that is coupled to the sensor assembly 24 via a connector bracket 306. The drive motor 300 is electrically connected to the control panel 28. As should be appreciated, rotation of the drive motor 300 will correspondingly rotate the drive shaft 302, which in turn threadingly engages the drive plate 304 to vertically displace the sensor assembly 24 in the direction of arrows A. The speed of the drive motor 300 is preferably controllable so as to correspondingly adjust or regulate the rate of vertical displacement of the sensor assembly 24. As illustrated in FIG. 4, the adjustment mechanism 26 provides the capability to selectively adjust the height $h_1$ of the sensor assembly 24 relative to the base unit 22 within a range of operational positions. In a preferred embodiment of the invention, the adjustment mechanism 26 is configured to provide approximately thirty-six (36) inches of vertical adjustment. However, it should be understood that other ranges of vertical adjustment are also contemplated as falling within the scope of the present invention, including vertical adjustments and/or vertical heights of greater than thirty-six (36) inches.

As illustrated in FIG. 2, the adjustment mechanism 26 is housed within the interior region 164 of the vertical support column 160 (the support column 160 having been removed from FIG. 9 for purposes of clarity). The drive motor 300 is secured to the vertical support column 160, and more specifically to the side wall 162*b*, via a number of fasteners 310 or by any other means for attachment. The driven end of the drive shaft 302 is rotatably coupled to the output shaft 312 of the drive motor 300 via a coupling 314, with the free end of the drive shaft 302 rotatably mounted to an upper mounting plate 316 via a bushing or bearing 318. The drive plate 304 defines an internally threaded opening 320 that threadingly receives the drive shaft 302. The threaded opening 320 may be machined directly into the drive plate 304 or may be defined by an internally threaded bushing insert. The drive plate 304 is attached to the connector bracket 306 by an intermediate L-shaped bracket 322 which is secured to the drive plate 304 and the connector plate 306 via a number of fasteners 324 or by any other means for attachment. Alternatively, the drive plate 304 and the connector bracket 306 may be integrally formed as a single piece.

As most clearly shown in FIGS. 2 and 9, in the illustrated embodiment of the invention, the adjustment mechanism 26 includes a pair of guide tracks or channels 330 and 332 positioned at the front and rear of the support column 160. Front and rear portions of the connector bracket 306 are slidably displaced along the guide tracks 330, 332 to stabilize the connector bracket 306 and the sensor assembly mounting structure 200, particularly during adjustment of the height $h_1$ of the position sensors 202. In one embodiment, the guide tracks 330, 332 are defined by a pair of vertically-extending bars or rods 334*a*, 334*b* spaced apart a distance sufficient to slidably receive the connector bracket 306 therebetween. The guide bars 334*a*, 334*b* are interconnected via an upper and lower studs or fasteners 336*a*, 336*b*. The studs 336*a*, 336*b* may define an externally threaded portion adapted for threading engagement within a threaded opening in one of the guide bars to provide a means for adjusting the width of the guide tracks 330, 332.

In one embodiment of the invention, the connector bracket 306 is pivotally attached to a mounting flange 340 extending from the base portion 206 of the sensor assembly mounting structure 200 via a pivot pin 342. In this manner, the sensor assembly 24 is allowed to pivot about a pivot axis $P_2$ between an operational position (FIG. 1), wherein the mounting arms 204*a*, 204*b* are arranged substantially perpendicular to the vertical support column 160, and a storage or transport position (FIG. 10) wherein the mounting arms 204*a*, 204*b* are arranged substantially parallel with the vertical support column 160. The sensor assembly 24 is selectively maintained in the operational position illustrated in FIG. 1 via abutment of an end surface of connector bracket 306 against the base portion 206 of the sensor assembly mounting structure 200. However, other means for selectively maintaining the sensor assembly 24 in the operational position are also contemplated as would occur to one of skill in the art. As should be appreciated, pivoting the sensor assembly 24 to the collapsed configuration illustrated in FIG. 10 provides for a more compact, lower profile configuration to facilitate transport of the exercise device 20 and/or storage of the exercise device 20 in areas having limited space, such as, for example, under a bed or in a closet.

Although a specific embodiment of an adjustment mechanism has been illustrated and described herein for adjusting the height $h_1$ of the position sensors 202, it should be understood that other means for adjustment are also contemplated as falling within the scope of the present invention. For example, a linear actuator could alternatively be used to adjust the height $h_1$, including various types and configurations of electric linear drives or pneumatic cylinder arrangements. A gear driven system is also contemplated, such as, for example, a rack and pinion type system. Additionally, a cabling system powered by a rotational or linear drive may also be used to adjust the height $h_1$. In another embodiment, a crank handle or a ratchet handle may be used to drive various types and configurations of adjustment mechanisms. In a further embodiment of the invention, the height $h_1$ may be manually adjusted by hand and locked into a selected position via a lock pin or clamp. Other means for adjusting the height $h_1$ are also contemplated as would occur to one of skill in the art. It should also be understood that in other embodiments of the invention, the sensor assembly 24 and the sensors 202 may be fixed at a predetermined non-adjustable height $h_1$.

According to one embodiment of the invention, as illustrated in FIG. 1, the control panel 28 is securely mounted to the upper end of the support column 160. The control panel 28 may be rotatably and/or pivotally mounted to the upper end of the support column 160 to accommodate for adjustment of the angular position and/or orientation of the control panel 28 relative to the user or a third party.

As discussed above, the control panel 28 controls and/or monitors the operation of the various electrical components associated with the exercise device 20. For example, the control panel 28 functions to activate/deactivate the light sources 132 in the base unit 22, power and receive feedback signals from the pressure sensors 190 in the base unit 22, power and receive feedback signals from the position sensors 202 of the position sensor assembly 24, and power and control operation of the electric drive motor 302 of the adjustment mechanism 26. As should be appreciated, the control panel 28 may also be used to control, monitor and/or power other electrical components associated with the exercise device 20 or other ancillary equipment. Power can be supplied to the control panel 28 and other electrical components via household current, one or more batteries, and/or by any other type of power supply known to those of skill in the art.

The control panel 28 is equipped with an electronic circuit board (not shown), a programmable controller (not shown) and/or any other type of electronic control system known to those of skill in the art. The control panel 28 preferably includes various buttons or keys 400 or other types of input devices (e.g., knobs, switches, a touch pad, etc.) to provide a user interface for inputting information and/or data to control operation of the various components and features associated with the exercise device 20. A heart monitor (not shown) may also be provided to monitor the user's heart rate, blood pressure, etc., the output of which may be communicated to the control panel 28 via a wireless or direct-wired connection.

The display 30 on the control panel 28 provides for direct visualization of various parameters that are indicative of the user's performance of an activity, such as, for example, information or data relating to the frequency and duration of the activity, the number of missteps or miscues, elapsed time, an estimate of the number of calories burned, measured heart rate or blood pressure, historical data relating to the activity, etc. The display 30 may also be used to convey other information or data to the user, such as, for example, component settings, a programming menu and/or operating instructions (e.g., a help screen), etc. In one embodiment of the invention, the display 30 is an LCD display. However, other types of displays are also contemplated, including plasma displays, CRT monitors, or any other type of display or monitor that would occur to one of skill in the art.

In addition to the display 30, the control panel 28 also includes a pair of indicator lights 402, 404 that provide visual indications or cues to the user to elicit a response, such as, for example, a jumping movement, and/or to provide visual confirmation or feedback signals to the user indicating that a predetermined parameter has been satisfied, such as, for example, jumping beyond a predetermined height (e.g., beyond the sensing plane S). In one embodiment, the indicator lights 402, 404 are of different colors (e.g., red and green) to allow the user to quickly and easily interpret the meaning behind the indication, cue, confirmation, and/or feedback signal corresponding to illumination of either of the lights 402, 404. The control panel 28 may also include a speaker or any other device that is capable of emitting a sound or tone to provide audible indications, cues, configurations and/or feedback signals to the user.

The exercise device 20 may also be equipped with a remote control device (not shown) configured to communicate with the control panel 28 to control operation of the various electrical components associated with the exercise device 20 from a remote location. The remote control device may include a display to provide remote visualization of various parameters associated with the user's performance of an activity, component settings, etc. The remote control device may be of the wireless type or may be hard wired into the control panel 28. The use of a remote control device may be particularly advantageous when a third party, such as, for example, a coach, trainer or instructor is present.

As illustrated in FIGS. 1 and 2, the exercise device 20 may be equipped with a pair of user supports or handrails 500*a*, 500*b* positioned on each side of the base unit 22. In one embodiment of the invention, the handrails 500*a*, 500*b* each include a rear portion 502 extending vertically from the base unit 22, a side portion 504 extending horizontally along the longitudinal axis L, and a front portion 506 extending horizontally along the transverse axis T and into engagement with the vertical support column 160. However, other configurations of handrails 500*a*, 500*b* are also contemplated as would occur to one of skill in the art. It should also be understood that the exercise device 20 need not necessarily be equipped with handrails.

Although the illustrated embodiment of the invention depicts the side portions 504 of the handrails 5002, 500*b* as having a generally linear configuration, it should be understood that the side portions 504 may be angled or curved. In a further embodiment of the invention, the side portions 504 have a generally circular cross section defining an outer diameter of between about one (1) inch and about three (3) inches to provide for secure and comfortable grasping by the user. Additionally, the side portions 504 may be treated to provide a non-slip surface to reduce the likelihood of user injury. Such a non-slip surface may be provided, for example, by roughening the outer surface of the side portions 504 via knurling or peening, by applying a non-slip material or coating to the outer surface of the side portions 504, and/or by providing hand grips that are formed of a non-slip material, such as, for example, plastic, rubber or foam.

In a further embodiment of the invention, the handrails 500*a*, 500*b* may be provided with a means for adjusting the height of the side portions 504 relative to the support pad 104 to accommodate users of different heights and/or different arm lengths. In one such embodiment, the vertically-extending rear portions 502 of the handrails 500*a*, 500*b* may include an inner tube portion that is telescopically received with an outer tube portion to provide for adjustment of the height of the side portions 504 relative to the support pad 104, and a clamp or fastener device, such as, for example, a pin or push button for locking the side portions 504 at a select height.

The handrails 500*a*, 500*b* are preferably selectively detachable from the base unit 22 and the support column 160 to accommodate transformation of the exercise device 20 into the collapsed configuration illustrated in FIG. 10 to facilitate transport and/or storage. In one embodiment of the invention, the ends of the vertical rear portions 502 of the handrails 500*a*, 500*b* are slidably received within mounting sleeves 508 extending upwardly from the mounting rails 130*a*, 130*b* of the base unit 22. Similarly, the ends of the horizontal front portions 506 of the handrails 500*a*, 500*b* are slidably received within mounting sleeves 510 extending laterally from the side walls 162*a*, 162*b* of the support column 160 (FIG. 2). The ends of the handrails 500*a*, 500*b* may be removably secured within the mounting sleeves 508, 510 via setscrews, pins, clamps, a friction fit, or by any other means of releasable engagement known to those of skill in the art. In an alternative embodiment of the invention, the handrails 500*a*, 500*b* may be pivotally attached to the base unit 22 in such a manner as to allow the handrails 500*a*, 500*b* to be folded to accommodate transformation of the exercise device 20 into the collapsed configuration illustrated in FIG. 10.

Having described the various components, functions and features associated with the exercise device 20, further details regarding the use and operation of the exercise devices will now be discussed below. According to one form of the invention, the exercise device 20 may be used to simulate the activity of jumping rope. In another embodiment of the invention, the exercise device 20 may be used in association with walking or running in place. With regard to the embodiment of the invention directed to the exercise activity involving a simulated jump rope, the control panel 28 is configured and/or programmed to activate (turn on) the light sources 132 in a sequential manner, preferably in a front to back direction (e.g., from the front of the base unit toward the rear of the base unit). However, it should be understood that the light sources 132 may alternatively be activated in a sequential manner in a back to front direction. As should be appreciated, activation of the light sources 132 associated with a corresponding light channel 170 will illuminate a discrete band or strip of the support pad 104 directly above that light channel 170. As should also be appreciated, upon the sequential activation of each light source 132, the adjacent light source 132 toward the front of the base unit 22 will be deactivated (turned off).

The sequential activation/deactivation of the light sources 132 has the effect of providing a virtual simulation of a jump rope passing beneath the user's feet. As illustrated in FIG. 8 and described above, the light channels 170' positioned toward the front and rear of the base unit 22 may be configured to have varying degrees of lateral curvature to provide an even more realistic simulation of a jump rope passing beneath the user's feet. The speed and frequency at which the light sources 132 are sequentially activated and deactivated can be varied via the control panel 28 to adjust the speed and frequency (e.g., cadence) at which the virtual jump rope passes beneath the user's feet, thereby enabling the user to control his or her aerobic workout level.

As the light sources 132 are sequentially activated and deactivated, the user is cued to react by "jumping over" the virtual jump rope (i.e., the illuminated light band extending across the support pad 104) as the virtual jump rope passes directly beneath the user's feet. Additionally, the user must jump high enough to clear the virtual jump rope. The position sensors 202 can function to verify or confirm that the user has in fact cleared the virtual jump rope as it passes beneath the user's feet. The pressure sensors 190 associated with the pressure sensitive pad or strip 108 may also be used to verify that the user actually jumped off of the support pad 104 and/or that the user jumped at the appropriate time to clear the virtual jump rope.

As should be appreciated, if the user jumps high enough to extend above the sensing plane S (i.e., above the light beams B), the position sensors 202 will send a confirmation signal to the control panel 28 that a successful jump has been executed. In turn, a visual and/or non-visual indication may be provided to confirm that the jump was successful. In one embodiment, one of the indicator lights 402, 404 (e.g., a green light) will illuminate to provide visual confirmation to the user that the jump was successful. However, other types of indications are also contemplated, such as, for example, other types of lights, graphical symbols, audible signals, and/or other types of visual and/or non-visual indications that would occur to one of skill in the art. If the user fails to extend above the sensing plane S, at least one of the light beams B will remain broken by the user's legs or feet. As a result, one or more of the position sensors 202 will send a signal to the control panel 28 indicating that the jump was unsuccessful (e.g., a miscue). In turn, a visual and/or non-visual indication may be provided to confirm that the jump was successful, such as, for example, illumination of one of the indicator lights 402, 404 (e.g., a red light) to provide visual confirmation to the user that the jump was unsuccessful. The light 402, 404 indicating a successful jump (e.g., the green light) will preferably remain illuminated until an unsuccessful jump has been detected. As discussed above, the height $h_1$ of the position sensors 202 may be adjusted to correspondingly adjust the height at which the user must jump to clear the virtual jump rope. As a result, the user is able to control his or her anaerobic workout level. It should be understood that the height $h_1$ of the position sensors 202 may be adjusted before or during the user's workout, and may be adjusted manually by the user or automatically by the control panel 28.

In one embodiment of the invention, the position sensors 202 may be sequentially activated/deactivated substantially synchronously with the sequential activation/deactivation of the light sources 132. In other words, the activation/deactivation of the position sensors 202 may be configured to substantially track the activation/deactivation of the light sources 132. As discussed above, the light beams B generated by the position sensors 202 may be configured to be visible by the user so as to provide a visual indication of the selected height $h_1$ of the position sensors 202 and the sensing plane S relative to the support pad 104. In this manner, the light beams B provide further simulation of the virtual jump rope passing beneath the user's feet while at the same time providing the user with an easily identifiable indication as to the height the user must jump to clear the virtual jump rope. In a further embodiment of the invention, additional light sources or cueing devices may be mounted to one or both of the mounting arms 204*a*, 204*b* of the sensor frame 200 which illuminate substantially synchronously with the respective light sources 132 to provide further indication as to when and how high the user must jump to clear the virtual jump rope. Non-visual signaling devices, such as, for example, audible signaling devices, may also be mounted to one or both of the mounting arms 204*a*, 204*b* of the sensor frame 200 to provide further indication as to when and how high the user must jump to clear the virtual jump rope.

The pressure sensors 190 associated with the pressure sensitive pad or strip 108 may be used in addition to or in lieu of the position sensors 202 to verify or confirm whether a jump was successful or unsuccessful. As should be appreciated, if the user jumps off of the support pad 104 at the appropriate time as the virtual jump rope passes beneath the user's feet, the pressure sensors 190 will send a confirmation signal to the control panel 28 that a successful jump has been executed and one of the indicator lights 402, 404 (e.g., a green light) will illuminate. However, if the user fails to jump off of the support pad 104 at the appropriate time, one or more of the pressure sensors 190 will send a signal to the control panel 28 indicating that the jump was unsuccessful and one of the indicator lights 402, 404 (e.g., a red light) will illuminate. The light 402, 404 indicating a successful jump (e.g., the green light) will preferably remain illuminated until an unsuccessful jump has been detected.

As discussed above, the control panel 28 may be configured to generate a visual signal on the display 30, an audible signal, and/or other types of signals to indicate that a particular jump was successful or unsuccessful. Additionally, it should be understood that the "signal" sent to the control panel 28 by the position sensors 202 and/or the pressure sensors 190 can take the form of an actual electronic signal or may take the form of the absence of an electronic signal. It should also be understood that the control panel 28 may be programmed with predetermined workout parameters or settings that will automatically vary the speed and frequency of the virtual jump rope passing beneath the user's feet and/or the height at which the user must jump to clear the virtual jump rope. In this manner, the user may work out without interruption or distraction and without having to manually change the parameters or settings of the exercise device 20.

The anaerobic benefits of the exercise device can be enhanced via the use of hand, waist or ankle weights in conjunction with the rope jumping activity. Notably, unlike the actual activity of jumping rope, the virtual jump rope generated by the exercise device 20 frees up the user's hands to allow the user to perform other functions (e.g., grasping hand weights, balancing via the handrails 500*a*, 500*b*, etc.). Additionally, the user does not have to concentrate on the proper handling of the rope and keeping their feet and legs clear of the rope, thereby enabling the user to concentrate solely on the jumping activity itself. As a result, user safety and comfort is significantly enhanced. Moreover, the user has a totally free range of motion with regard to both their hands and legs.

With regard to the embodiment of the invention directed to use of the exercise device 20 in association with the activity of walking or running in place, as illustrated in FIGS. 1 and 3, the base unit 22 and the sensor assembly 24 are configured to define a first zone $Z_1$ and a second zone $Z_2$, with each of the zones extending generally along the transverse axis T. However, it should be understood that the base unit 22 and the sensor assembly 24 may be divided into any number of zones, including three or more zones, and that the zones may extend in other directions, including a direction extending generally along the longitudinal axis L. Each of the first and second zones $Z_1$, $Z_2$ includes a number of the light sources 132 that selectively illuminate a corresponding number of the light channels 170, and a number of position sensors 202 that emit a corresponding number of the light beams B. Although the illustrated embodiment of the invention depicts each of the zones $Z_1$, $Z_2$ as having four (4) light channels 170 and four (4) light beams B, it should be understood that other configurations are also contemplated, including configurations wherein each of the zones $Z_1$, $Z_2$ include a single light channel 170 and a single light beam B.

In the illustrated embodiment of the invention, the user faces a transverse direction (i.e., toward either side of the base unit 22) and places one foot (e.g., the right foot) within the first zone $Z_1$ and the other foot (e.g., the left foot) within the second zone $Z_2$. The control panel 28 is configured and/or programmed to activate and deactivate the light sources 132 in the first and second zones $Z_1$, $Z_2$ in an alternating manner. Activation of the light sources 132 in the first zone $Z_1$ cues the user to react by raising his or her right foot off of the support pad 104. After a period of time, the light sources 132 in the first zone $Z_1$ will deactivate, thereby cueing the user to react by placing his or her right foot back onto the support pad 104. The light sources 132 in the second zone $Z_s$ will then activate, cueing the user to react by raising his or her left foot off of the support pad 104. In one embodiment, activation of light sources 132 in the second zone $Z_s$ occurs virtually simultaneously with deactivation of the light sources 132 in the first zone $Z_1$. However, a delay between activation and deactivation of the light sources 132 associated with the first and second zones $Z_1$, $Z_2$ is also contemplated. After a period of time, the light sources 132 in the second zone $Z_2$ will deactivate, thereby cueing the user to react by placing his or her left foot back onto the support pad 104. The light sources 132 in the first zone $Z_1$ will once again activate, and the activation/deactivation sequence of the first and second zones $Z_1$, $Z_2$ will be repeated indefinitely. It should be understood that in another embodiment of the invention, deactivation of the light sources 132 may be used to cue the user to raise his or her foot off of the support pad 104, while activation of the light sources cues the user to place his or her foot back onto the support pad 104.

As should now be appreciated, activation and deactivation of the first and second zones $Z_1$, $Z_2$ in an alternating manner provides the user with visual indications which, if followed, will cue the user to walk or run in place. As should also be appreciated, the speed at which the first and second zones $Z_1$, $Z_2$ are activated and deactivated can be varied via the control panel 28 to adjust the speed (i.e., cadence) at which the user must walk or run in place, thereby enabling the user to control his or her aerobic workout level. The user may set the speed before beginning the workout or may manually adjust the speed setting at any point during the workout. Additionally, the control panel 28 may be programmed with various speed settings that remain constant throughout the user's workout, or which are automatically adjust at various points during the user's workout. In this manner, the user may work out without interruption or distraction.

In another aspect of the invention, the position sensors 202 may be used to verify or confirm that the user raised his or her foot off of the corresponding zone $Z_1$, $Z_2$ at the appropriate time and at the appropriate elevation above the upper surface 105 of the support pad 104. In a further aspect of the invention, pressure sensors 190 located beneath respective ones of the first and second zones $Z_1$, $Z_2$ may also be used to verify that the user raised his or her foot off of the corresponding zone $Z_1$, $Z_2$ at the appropriate point in time.

As should be appreciated, if the user raises his or her foot high enough to extend above the sensing plane S (i.e., above the light beams B), the position sensors 202 will send a confirmation signal to the control panel 28 indicating that the user is successfully performing the walking/running activity. In turn, one of the indicator lights 402, 404 (e.g., a green light) will illuminate to provide visual confirmation to the user that he or she is performing successfully. However, if the user fails to extend above the sensing plane S, at least one of the light beams B will remain broken by the user's leg or foot. As a result, one or more of the position sensors 202 will send a signal to the control panel 28 indicating the user's unsuccessful performance of the activity (e.g., a misstep or miscue). In turn, one of the indicator lights 402, 404 (e.g., a red light) will illuminate to provide visual confirmation to the user regarding his or her unsuccessful performance of the activity. The light 402, 404 indicating successful performance (e.g., the green light) will preferably remain illuminated until a misstep or miscue has been detected. As discussed above, the height $h_1$ of the position sensors 202 may be adjusted relative to the upper surface 105 of the support pad 104, thereby resulting in an adjustment to the height at which the user must raise his or her feet to clear the light beams B. As a result, the user is able to control his or her anaerobic workout level. It should be understood that the height $h_1$ of the position sensors 202 may be adjusted before or during the user's workout, and may be adjusted manually by the user or automatically by the control panel 28.

In one embodiment of the invention, the position sensors 202 associated with each of the respective zone $Z_1$, $Z_2$ may be activated/deactivated in an alternating manner to correspond with the alternating activation/deactivation of the light sources 132. In other words, the activation/deactivation of the position sensors 202 within the respective zone $Z_1$, $Z_2$ may be configured to substantially track the activation/deactivation of the light sources 132 within the respective zone $Z_1$, $Z_2$. As discussed above, the light beams B generated by the position sensors 202 may be configured to be visible by the user so as to provide a visual indication of the selected height $h_1$ of the position sensors 202 and the sensing plane S relative to the support pad 104. In this manner, the light beams B provide the user with an easily identifiable indication as to the height at which the user's foot must be raised to clear the sensing plane S. In a further embodiment of the invention, additional light sources or cueing devices may be used to cue the user as to when his or her foot should be raised off of the support pad 104. In one embodiment, additional light sources or cueing devices may be mounted to one or both of the mounting arms 204*a*, 204*b*, or at other locations, which illuminate substantially synchronously with the light sources 132 within the respective zone $Z_1$, $Z_2$ to provide further indication as to when the user must raise his or her foot off of the support pad 104.

The pressure sensors 190 located beneath respective ones of the first and second zones $Z_1$, $Z_2$ may be used in addition to or in lieu of the position sensors 202 to verify or confirm whether the user is performing the walking/running activity successfully or unsuccessfully. As should be appreciated, the pressure sensors 190 may be used to verify or confirm that the user raised his or her foot off of the corresponding zone $Z_1$, $Z_2$ at the appropriate point in time. If the user's performance is successful, the pressure sensors 190 will send a confirmation signal to the control panel 28 and one of the indicator lights 402, 404 (e.g., a green light) will illuminate. However, if the user is unsuccessful, one or more of the pressure sensors 190 will send a signal to the control panel 28 and one of the indicator lights 402, 404 (e.g., a red light) will illuminate. The light 402, 404 indicating successful performance (e.g., the green light) will preferably remain illuminated until a misstep or miscue has been detected.

As discussed above, the control panel 28 may be configured to generate a visual signal on the display 30, an audible signal, and/or other types of signals to indicate that the user's performance was successful or unsuccessful. Additionally, it should be understood that the "signal" sent to the control panel 28 by the position sensors 202 and/or the pressure sensors 190 can take the form of an actual electronic signal or may take the form of the absence of an electronic signal.

Figure 11:
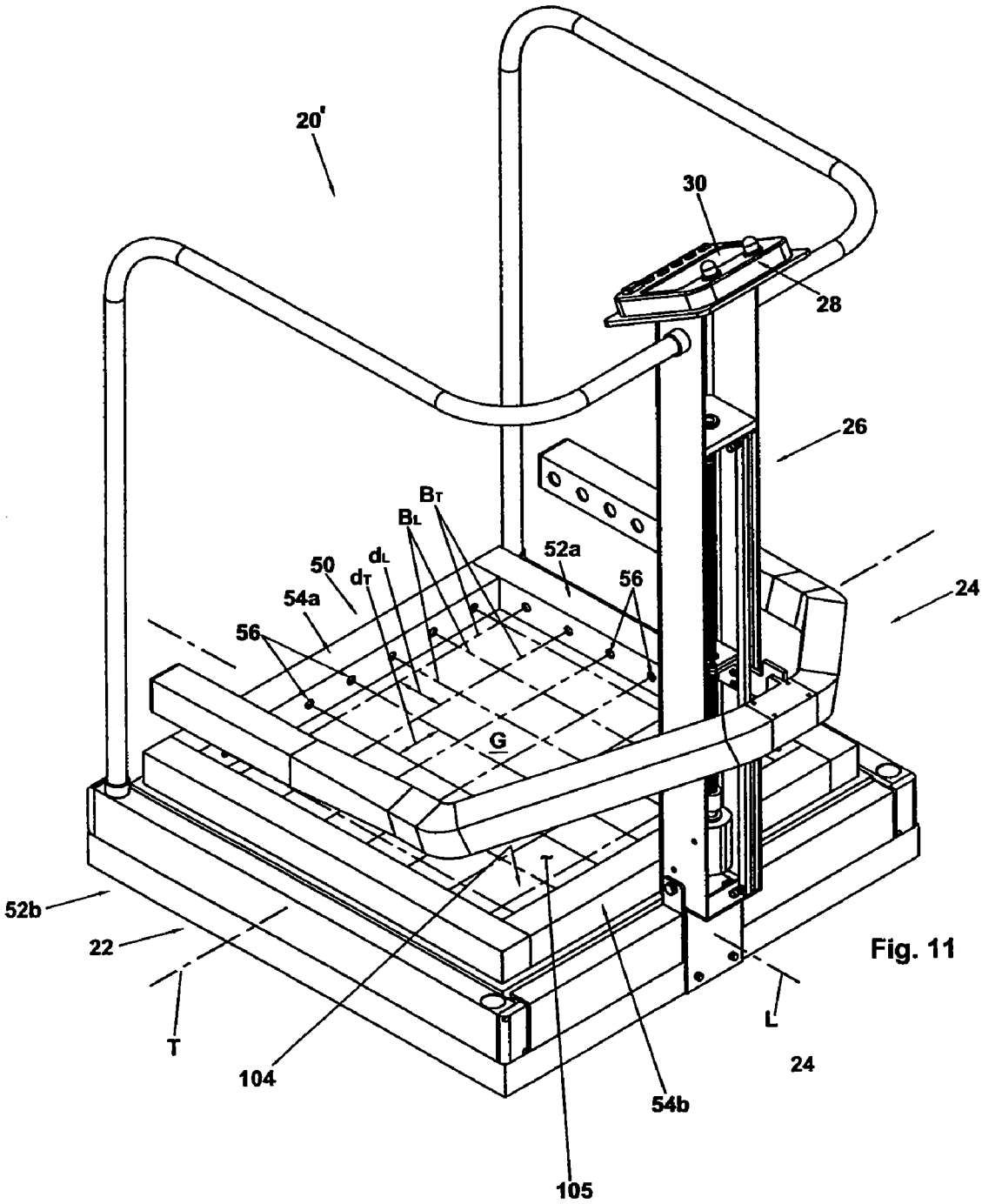
FIG. 11 is a rear elevational perspective view of an alternative embodiment of the exercise device illustrated in FIG. 1.

Referring to FIG. 11, shown therein is an alternative embodiment of the exercise device 20 illustrated and described above. In many ways, the exercise device 20' is configured similar to the exercise device 20, including a base unit 22, an adjustable position sensor assembly 24, an adjustment mechanism 26, a control panel 28, and a monitor or display 30. However, the exercise device 20' is additionally equipped with a stationary position sensor assembly 50.

In one embodiment of the invention, the stationary position sensor assembly 50 includes a number of sensor elements that serve to determine the position and/or orientation of the user's feet relative to the upper surface 105 of the support pad 104, the details of which will be discussed below. In other embodiments of the invention, the stationary position sensor assembly 50 may be used in a manner similar to that of the adjustable sensor assembly 24 to determine whether or not the user's response to a cue or signal satisfies a predetermined objective or goal, such as, for example, a predetermined elevation and/or an elapsed period of time. In the illustrated embodiment, the stationary position sensor assembly 50 is used in combination with the adjustable position sensor assembly 24. However, it should be understood that in other embodiments of the invention, the stationary position sensor assembly 50 may be used without the adjustable position sensor assembly 24.

According to one embodiment of the invention, the stationary position sensor assembly 50 is generally comprised of a pair of spaced apart mounting structures 52*a*, 52*b* extending along the length of the base unit 22 in a direction generally parallel with the longitudinal axis L, and a pair of spaced apart mounting structures 54*a*, 54*b* extending across the width of the base unit 22 in a direction generally parallel with the transverse axis T. The mounting structures 52*a*, 52*b* and 54*a*, 54*b* are preferably securely mounted to the support pad 104 or to other portions of the base unit 22. A plurality of position sensors 56 are mounted to each of the mounting structures 52*a*, 52*b* and 54*a*, 54*b*. Each of the position sensors 56 are preferably positioned at a predetermined distance above the support surface 105 so as to define a sensing grid G arranged approximately parallel with the support surface 105. In this manner, the position sensors 56 will be able to detect the presence or absence of the user's feet along the sensing grid G.

In one embodiment of the invention, the mounting structures 52*a*, 52*b* and 54*a*, 54*b* are configured substantially identical to one another and have a tubular configuration defining a hollow interior region for receiving the sensors 56. In a specific embodiment, the position sensors 56 are mounted within the tubes 52*a*, 52*b* and 54*a*, 54*b* in a manner similar to that described above with regard to the adjustable position sensor assembly 24 (e.g., via a mounting bracket similar to that of mounting bracket 216 and generally aligned with sensor apertures in the tubes similar to sensor apertures 212). However, it should be understood that other configurations of the mounting tubes 52*a*, 52*b* and 54*a*, 54*b* are also contemplated as falling within the scope of the present invention.

In one embodiment of the invention, the position sensors 56 are of the photoelectric type, with each position sensor 56 including opposing emitter and receiver units configured similar to the emitter and receiver units E, R illustrated and described above with regard to the position sensors 202 associated with the adjustable position sensor assembly 24. Similar to the position sensors 202 illustrated in FIG. 3, the opposing pairs of the emitter and receiver units are preferably arranged in a staggered or alternating configuration such that the receiver units are separated from one another by an intermediate emitter unit. As a result, the likelihood that a receiver unit will erroneously detect the light beam emitted from the wrong emitter unit is significantly reduced. However, it should be understood that other configurations are also contemplated, including configurations where all of the emitter units are mounted to one of the mounting tubes (e.g., tubes 52*a*, 54*a*) and all of the receiver units are mounted to the opposite mounting tube (e.g., tubes 52*b*, 54*b*).

Although the position sensors 56 have been described as photoelectric-type sensors, with each position sensor 56 including an emitter unit and a receiver unit, it should be understood that other types and configurations of position sensors are also contemplate as falling within the scope of the present invention. For example, instead of having separate emitter and receiver units, in other embodiments of the invention, the emitter and receiver elements may be integrated into a single unit, with an optical reflector mounted opposite the integrated position sensor to complete the optical sensor circuit. Additionally, in lieu of photoelectric-type sensors, the stationary position sensor assembly 50 may utilize other types of position sensors, including various types and configurations of laser sensors, fiber optic sensors, optical sensors, motion sensors, infrared sensors, thermal sensors, ultrasonic sensors, capacitive sensors, proximity sensors, or any other type of position sensor that would occur to one of skill in the art.

As illustrated in FIG. 11, the sensor assembly mounting tubes 52*a*, 52*b* and 54*a*, 54*b* extend about the outer perimeter of the support pad 104 and are positioned directly above the support surface 105. The position sensors 56 are disposed at intermittent locations along the mounting tubes 52*a*, 52*b* and 54*a*, 54*b*, preferably at uniform intervals, such that the longitudinal distance $d_L$ separating the position sensors 56 associated with the mounting tubes 52*a*, 52*b* is approximately equal to the transverse distance $d_T$ separating the position sensors 56 associated with the mounting tubes 54*a*, 54*b*. In this manner, the transverse beams of light $B_T$ emitted/received by the position sensors 56 associated with the mounting tubes 52*a*, 52*b* and the longitudinal beams of light $B_L$ emitted/received by the position sensors 56 associated with the mounting tubes 54*a*, 54*b* will form the sensing grid G at a predetermined distance above and preferably substantially parallel to the support surface 105.

As should be appreciated, the longitudinal and transverse distances $d_L$, $d_T$ separating the position sensors 56 may be increased/decreased to correspondingly vary the sensing density of the sensing grid G, which would in turn increase/decrease the sensing accuracy of the stationary position sensor assembly 50. As should also be appreciated, the longitudinal and transverse distances $d_L$, $d_T$ separating the position sensors 56 need not necessarily be equal to one another, but may instead take on different values to correspondingly vary the sensing density/accuracy along the longitudinal axis L relative to the sensing density/accuracy along transverse axis T. Additionally, although the position sensors 56 and the sensing grid G are illustrated as being positioned just above the support surface 105, it should be understood that the position sensors 56 and the sensing grid G may alternatively be positioned at other predetermined elevations above the support surface 105.

As should be appreciated, when there is no obstruction present between respective pairs of the emitter and receiver units, the corresponding light beams $B_T$, $B_L$ will remain unbroken and the receiver units will communicate a signal to the control panel 28 indicating an uninterrupted sensor condition. However, when any of the light beams $B_T$, $B_L$ are broken by an obstruction (e.g., by the user's feet) the receiver units will communicate a signal to the control panel 28 indicating an interrupted sensor condition. Accordingly, the position sensors 56 are capable of detecting the presence or absence of the user's feet along the sensing grid G, and are likewise capable of determining the position and/or orientation of the user's feet relative to the base unit 22, the details of which will be discussed below.

As indicated above, in one embodiment of the invention, the stationary position sensor assembly 50 may be used in a manner similar to that of the adjustable sensor assembly 24 to determine whether or not the user's response to a cue or signal satisfies a predetermined objective or goal. For example, the position sensors 56 may be used to determine whether or not the user has jumped or otherwise extended vertically beyond the sensing grid G, which for practical purposes would determine whether or not either of the user's feet have left the support surface 105 at the appropriate time in response to a signal or cue. The position sensors 56 may also be used to determine the approximate point in time in which the user's feet return to the support surface 105. In this regard, the position sensors 56 may be used in manner similar to that of the pressure sensors 190.

In a further embodiment of the invention, the stationary position sensor assembly 50 may be used to determine the position and/or orientation of the user's feet prior to, during, and/or after an activity, such as, for example, a jumping activity or a walking/running activity. With regard to a vertical jumping activity, immediately prior to initiation of a signal or cue instructing the user to jump off of the support surface 105, the position sensors 56 may be used to determine the position and/or orientation of the user's feet by determining which of the position sensors 56 are indicating an interrupted condition (i.e., an obstruction of the light beams $B_T$, $B_L$ by the user's feet). The receiver units indicating an interrupted condition will communicate a signal to the control panel 28, with the control panel 28 in turn determining or "plotting" the position and/or orientation of the user's feet along the sensing grid G. Additionally, immediately after completion of the jump (i.e., when the user's feet return to the support surface 105), the position sensors 56 may once again be used to determine or plot the position and/or orientation of the user's feet. In this manner, the stationary position sensor assembly 50 may be used to determine the overall efficiency of the user's vertical jump attempt. For example, if the user's feet are determined to be in approximately the same position and orientation immediately after the jump attempt as they were immediately prior to the jump attempt, the measured efficiency of the jump will be high. However, if the user's feet are in a different position and/or orientation, the measured efficiency of the jump will be comparatively low.

With regard to a walking/running activity, plotting the position and orientation of the user's feet during a walking/running activity may provide useful feedback to measure and monitor walking/running mechanics. This may be particularly useful with regard to therapeutic applications to provide a therapist, trainer or other personnel with real time feedback regarding the positioning and orientation of the user's feet during a walking/running activity. It should be understood that the stationary position sensor assembly 50 may be used in applications other than those specifically described above, including the use of multiple parallel sensor assemblies, and that the particular embodiments discussed herein are exemplary, it being understood that other applications are contemplated as falling within the scope of the present invention.

Although the position sensor assemblies 24 and 50 and the pressure sensitive pad or strip 108 have been described as being primarily used as a means to provide a signal or indication corresponding to the user's position relative to the support surface 105, it should be understood that these elements may also be used as a means to measure parameters associated with the user's performance of various activities. For example, with regard to a jump rope simulation activity, the position sensor assemblies 24, 50 and/or the pressure pad 108 may be used to measure the jump speed, cadence or jump height of the user. This measurement may in turn be used to adjust the settings of the exercise device (e.g., speed or cadence at which the light channels 170 are activated/deactivated and/or the height of the sensor assembly 24) to more closely match the capabilities of the user. Similarly, with regard to the activities of walking or running in place, the position sensor assemblies 24, 50 and/or the pressure pad 108 may likewise be used to measure parameters associated with walking or running (e.g., speed, distance, stride length, foot height, etc.), which may in turn be used to adjust the settings of the exercise device to more closely match the capabilities of the user. A similar arrangement may also be used in association with the vertical jumping activity.

In a further embodiment of the invention, one or more of the exercise device embodiments illustrated and described above may include a closed loop feedback mode whereby the user would have the ability, if desired, to input their weight, the length of time they wish to jump, the cadence at which they would like to jump, how many calories they would like to burn, the height that they want to jump, and/or any other parameter or criteria relating to the user and/or to the activity of the user, all as a means of goal setting. The user would be able to select any one of the inputs, all of the inputs, or any combination of the inputs. In addition, the exercise device would have the ability to break down the total exercise time into smaller time segments whereby the desired speed and height might change from one exercise segment to another.

Regardless of the inputs selected, the light channels below the user's feet will illuminate sequentially faster as the user jumps faster and slower as the user jumps slower. The light channels will illuminate sequentially as soon as the sensors indicate that the user's feet have left the jumping surface, thereby showing the virtual jump rope successfully passing beneath the user's feet. Should the user desire to merely jump indiscriminately at various cadences and heights and be timed as to how long the user has been exercising and be provided with feedback with regard to the selected exercise activity, the device will permit this as well. The user will start the device and jump at a selected cadence and height, either of which can be automatically changed by jumping at a cadence that is faster/slower and/or higher/lower, completely at the user's discretion. The device would then provide immediate feedback as to how fast they are jumping (in jumps per minute or JPMs), how high they are jumping (in inches or centimeters), how many calories per hour they are burning, how many total calories they have burned during the session, how long they have been exercising, and/or how long they have to jump to achieve their goal. In addition, an average cadence and average rope height will be calculated for the entire exercise session. If the user would like to merely count calories, they can also achieve this by simply jumping on the device.

If preprogrammed goals are selected for speed and height, and those goals are being met, a green light will illuminate or another type of indicia will be activated with every successful jump, and the display will reflect the measured instantaneous speed and height. If one or both of the parameters are not being met (i.e., if the user is jumping too slow or not jumping high enough), a red light will illuminate or another type of indicia will be activated with every unsuccessful jump until the deficiency is remedied. For example, the display which illustrates the measured speed at which the user is jumping will flash repeatedly in the form of a flashing number if the user's cadence is too slow, and/or the display which illustrates the measured jump height will show a flashing number if the jump height is too low. In addition, an average cadence and average rope height will be calculated for the entire session. Also, one or more displays may show the percentage of jumps that have met or exceeded the speed goal and/or the percentage of jumps that have met or exceeded the height goal.

If the user wishes to merely input the number of calories they would like to burn, they can input their weight, desired cadence and desired rope height and the device will calculate the time required to achieve this goal. The calculated time to meet the calorie goal will then be displayed and counted down. The device will still continuously calculate calories burned based on the actual exercise performed. If the user falls short of their calorie goal based on their activity at the end of the allotted time period, the time display will reset showing the amount of additional time that will be required based on an average of the activity level of the user throughout the duration of the original time period calculated. If the user does not select a cadence and rope height, the device will merely count calories based on the cadence and height of each jump and the time display will count up until the caloric goal is achieved. The calorie calculations will be estimated by data currently being collected through research that is being performed on the device and will take both cadence and rope height into consideration. In the absence of the user inputting their weight, all calorie calculations will be based on the assumption that the user weighs 150 pounds, which corresponds to the use weight standard in the exercise industry.

Referring to FIGS. 12-19, shown therein are exercise devices 800, 900 and 1000 according to further forms of the present invention. As will be discussed in greater detail below, the exercise devices 800, 900 and 1000 include features that provide a workout to both the upper and lower body of the user. The exercise device 800 is generally comprised of a lower body base unit configured similar or identical to the exercise device 20 illustrated and described above for providing a workout of the lower body, in combination with an upper body unit 802 for simultaneously providing a workout of the upper body. Similarly, the exercise device 900 is generally comprised of a lower body base unit configured similar or identical to the exercise device 20 illustrated and described above for providing a workout of the lower body, in combination with an upper body unit 902 for simultaneously providing a workout of the upper body. The exercise device 1000 is also generally comprised of a lower body base unit configured similar or identical to the exercise device 20 illustrated and described above for providing a workout of the lower body, in combination with an upper body unit 1002 for simultaneously providing a workout of the upper body.

It should be understood, however, that in other embodiments of the invention, one or more of the exercise devices 800, 900 and 1000 may include modified versions of the lower body base unit 20. For example, in an alternative embodiment, the size of the footprint area of the support base 22 which defines the upper support surface 105 may be enlarged to provide a greater area for performing various user activities. The position sensor assembly 24 may likewise be enlarged to avoid interference with user activities, or may be removed. Other changes, additions and/or modifications to the lower body base unit 20, the support base 22, the position sensor assembly 24, the adjustment mechanism 26 and/or the control panel 28 are also contemplated. Additionally, the exercise devices 800, 900 and 1000 need not necessarily include the handrails 500*a*, 500*b*, and need not necessarily be configured to fold down into a collapsed configuration, as described above and illustrated in FIG. 10.

Figure 12:
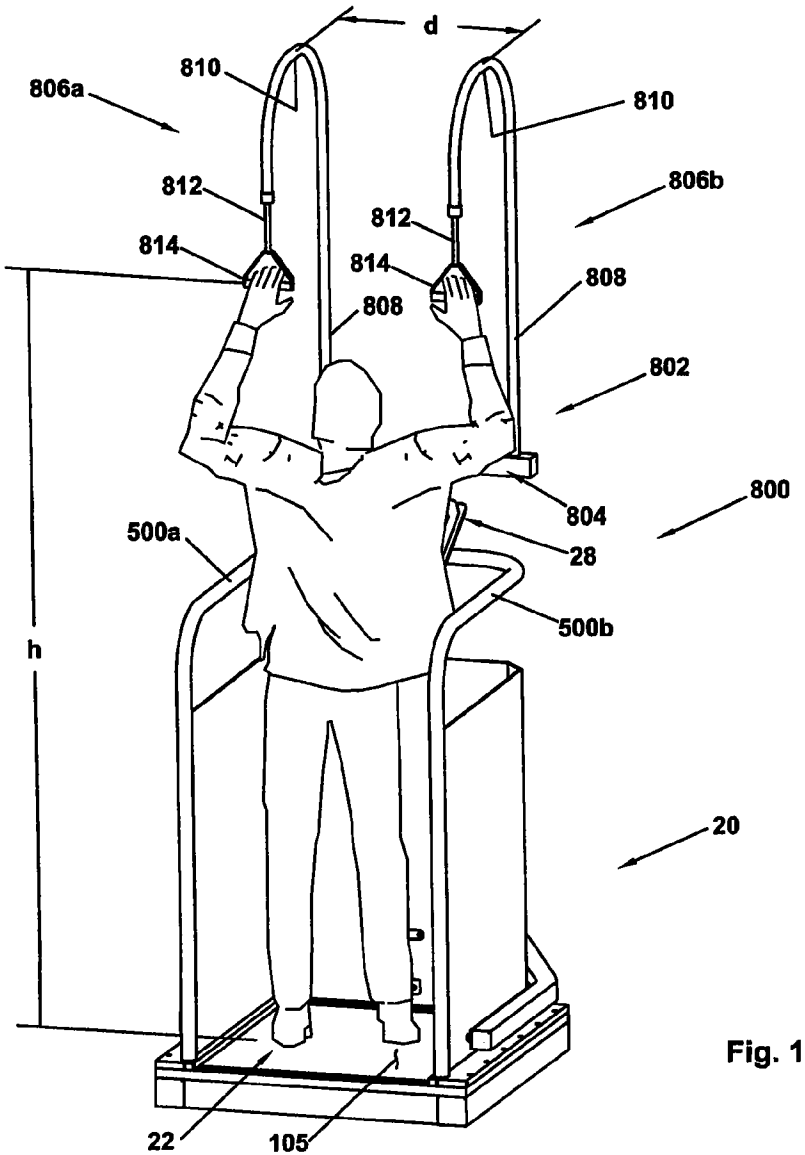
FIG. 12 is a rear elevational perspective view of an exercise device according to another form of the present invention.

Referring to FIG. 12, the upper body unit 802 associated with the exercise device 800 is generally comprised of a support structure 804 and load members 806*a*, 806*b* that are operatively coupled to the support structure 804. In the illustrated embodiment, the support structure 804 is configured as a horizontal mounting bar or block that is mounted to the vertical support column 160 or to any other portion of the lower body base unit 20.

The load members 806*a*, 806*b* are preferably configured identical to one another and are centrally positioned relative to the vertical support column 160 and laterally offset from one another by a distance d, which preferably corresponds to a distance equal to or somewhat greater than the average spacing between a user's arms or shoulders. However, other distances d are also contemplated. In one embodiment, the load members 806*a*, 806*b* each include a vertical beam or column portion 808 extending from the support structure 804, a hook or curved transition portion 810 extending from the column portion 808, a flexibly elastic and resilient portion 812 attached to the distal or free end of the hook 810, and a ring or gripping portion 814 attached to an end of the flexibly elastic and resilient portion 812. The load members 806*a*, 806*b* are preferably configured such that the rings 814 are positioned at a height h above the upper support surface 105 of the support base 22, which preferably corresponds to a height of the user's hands when the user's arms are in a vertically extended position. However, other heights h are also contemplated. The load members 806*a*, 806*b* may be stationarily mounted in a fixed position, or may be movably mounted and/or configured in a manner that allows for adjustment to the distance d between the rings 814 and/or the height h of the rings 814 above the upper support surface 105. Such adjustment may provided via various types and configurations of adjustments mechanisms, and may be manually adjustable or may be automated and controlled via the control panel 28 and an actuator, such as, for example, an electric, hydraulic or pneumatic motor, a hydraulic or pneumatic cylinder, or any other rotary or linear actuator that would occur to one of skill in the art.

In one embodiment, the flexibly elastic/resilient portions 812 are configured as flexible bands or straps that are formed of an elastomeric material capable of being stretched and elastically deformed as the user exerts an applied force, such as a pulling force, on the rings 814, and which resiliently reforms and returns toward a non-stretched or unstressed state upon release or reduction of the pulling force on the rings 814. As a pulling force is applied to the rings 814, the flexibly elastic/resilient portions 812 are stretched from a first initial length $l_1$ to a second length $l_2$, and returns toward the first initial length $l_1$ upon release or reduction of the pulling force. The flexibly elastic/resilient portions 812 may be formed of any material that is capable of being elastically deformed from an initial state to a deformed state, and resiliently reformed back toward the initial state. Such materials include, for example, rubber or rubber-like materials, polymeric or plastic materials, composite materials, metallic materials, shape-memory materials, including polymer-based and metallic-based shape-memory materials, or any other suitable elastic/resilient material that would occur to one of skill in the art.

As should be appreciated, the user stands of the upper support surface 105 of the support base 22 and may perform any of the exercise activities described above in association with the exercise device 20 to provide a workout of the lower body (e.g., jumping rope, walking/running in place, vertical jumping, etc.). While exercising the lower body, the user may grasp and pull on the rings 814 of the load members 806*a*, 806*b* to simultaneously provide a workout of the upper body. As should be appreciated, the flexibly elastic/resilient portions 812 are loaded as a force is applied to the rings 814, which in turn resists movement of the user's arms as the user pulls on the rings 814. However, in other embodiments of the invention, the load members 806*a*, 806*b* may be configured without the flexibly elastic/resilient portions 812, thereby maintaining the rings 814 in a fixed position. In this embodiment, the user may grasp the rings 814 and pull himself/herself off of the support base 22 while performing an exercise activity. In this manner, the weight of the user provides loading or resistance to workout the user's upper body, which is similar to performing chin-ups or other pull up exercises.

Although the load members 806*a*, 806*b* have been illustrated and described as having a particular configuration, it should be understood that other configurations are also contemplated. For example, instead of providing the flexibly elastic/resilient portion 812, the vertical column portion 808 and/or the hook portion 810 may be formed of a flexibly elastic/resilient material such that the load member 806*a*, 806*b* flex or bend as the user pulls on the rings 814. In such embodiments, the load members 806*a*, 806*b* could be configured as curved or arcuate-shaped rods or bars that flex or bend in a manner similar to the flexible bars or rods associated with a Bowflex™ home gym. Additionally, although the load members 806*a*, 806*b* are illustrated as including rings 814, other gripping devices are also contemplated for manual grasping by the user, including various types and configurations of handles, including devices configured similar to the ends of a jump rope.

Figure 13:
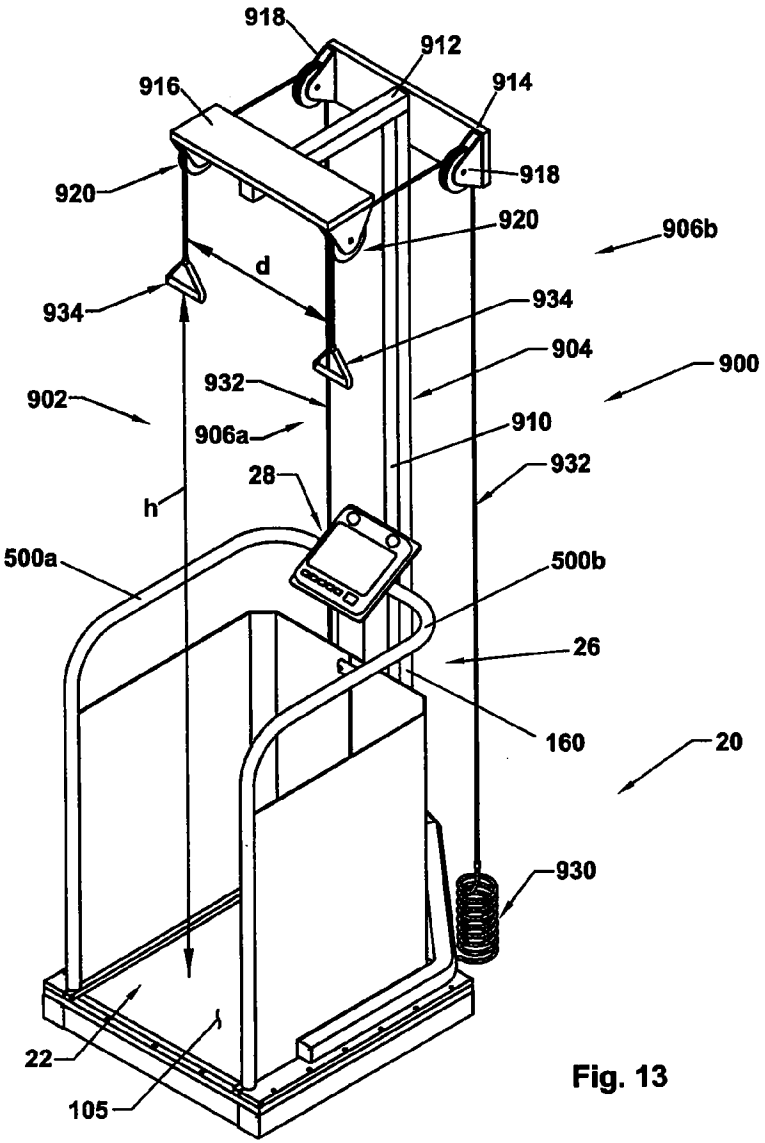
FIG. 13 is a rear elevational perspective view of an exercise device according to a further form of the present invention.

Referring to FIG. 13, the upper body unit 902 associated with the exercise device 900 is generally comprised of a support structure 904 and load members 906*a*, 906*b* that are coupled to the support structure 904. In the illustrated embodiment, the support structure 904 has an L-shaped configuration, including a vertical support 910 mounted to the vertical support column 160 or to any other portion of the support base 22, a horizontal support 912 extending transversely from the vertical support 910, a rear horizontal bar 914 mounted to the vertical support 910, and a front horizontal bar 916 mounted to the horizontal support 912. A pair of pulleys/sheaves or eyelets 918 are mounted to the rear horizontal bar 914, and a pair of pulleys/sheaves or eyelets 920 are mounted to the front horizontal bar 916.

The load members 906*a*, 906*b* are preferably configured identical to one another and are laterally offset from one another by a distance d, which preferably corresponds to a distance equal to or somewhat greater than the average spacing between a user's arms or shoulders. However, other distances d are also contemplated. In one embodiment, the load members 906*a*, 906*b* each include a flexibly elastic and resilient element 930 attached to the support base 22, a rope or cable 932 extending from the flexibly elastic/resilient element 930 and wrapped about the rear and front pulleys/sheaves or eyelets 918, 920, and a ring or gripping portions 934 attached to an end of the cable 932. The length of the cable 932 is preferably selected such that the rings 914 are positioned at a height h above the upper support surface 105 of the support base 22, which preferably corresponds to a height of the user's hands when the user's arms are in a vertically extended position. However, other heights h are also contemplated. The load members 906*a*, 906*b* may be stationarily mounted in a fixed position, or may be movably mounted and/or configured in a manner that allows for adjustment to the distance d between the rings 934 and/or the height h of the rings 934 above the upper support surface 105. Such adjustment may provided via various types and configurations of adjustments mechanisms, and may be manually adjustable or may be automated and controlled via the control panel 28 and an actuator, such as, for example, an electric, hydraulic or pneumatic motor, a hydraulic or pneumatic cylinder, or any other rotary or linear actuator that would occur to one of skill in the art.

In one embodiment, the flexibly elastic/resilient elements 930 are configured as coil springs, which may be formed of a metallic material or other types of elastic/resilient materials that are capable of being elastically deformed and expanded as the user exerts an applied force, such as a pulling force, on the rings 934, and which resiliently reforms and returns toward a contracted or unstressed state upon release or reduction of the pulling force on the rings 934. The coil springs 930 may be formed of any suitable material including, for example, polymeric or plastic materials, composite materials, metallic materials, shape-memory materials, including polymer-based and metallic-based shape-memory materials, or any other suitable elastic/resilient material that would occur to one of skill in the art. As a pulling force is applied to the rings 934, the coil springs 930 are stretched and expanded from a first initial length $l_1$ to a second length $l_2$, and contract and return toward the first initial length $l_1$ upon release or reduction of the pulling force.

As should be appreciated, the user stands of the upper support surface 105 of the support base 22 and may perform any of the exercise activities described above in association with the exercise device 20 to provide a workout of the lower body (e.g., jumping rope, walking/running in place, vertical jumping, etc.). While exercising the lower body, the user may grasp and pull on the rings 934 of the load members 906*a*, 906*b* to simultaneously provide a workout of the upper body. As should be appreciated, the flexibly elastic/resilient portions 930 are expanded and are loaded as a force is applied to the rings 934, which in turn resists movement of the user's arms as the user pulls on the rings 934. However, in other embodiments of the invention, the load members 906*a*, 906*b* may be configured without the flexibly elastic/resilient portions 930, thereby maintaining the rings 934 in a fixed position. In this embodiment, the user may grasp the rings 934 and pull himself/herself off of the support base 22 while performing an exercise activity. In this manner, the weight of the user provides loading or resistance to workout the user's upper body, which is similar to performing chin-ups or other pull up exercises. In still other embodiments of the invention, the flexibly elastic/resilient portions 930 may be replaced with other types of resistance elements, including piston-type elements which provide resistance via an increase in fluid or air pressure as the user exerts an applied force, such as a pulling force, on the rings 934, and with the increased fluid or air pressure causing the resistance elements to return toward the initial state upon release or reduction of the pulling force on the rings 934. In other embodiments, or with one or more weights may be attached to the ends of the cables 932 to provide gravitational resistance. If weights are used, a guide structure is preferably provided to guide the weights along a predetermined vertical path.

Although the load members 906*a*, 906*b* have been illustrated and described as having a particular configuration, it should be understood that other configurations are also contemplated. For example, the flexibly elastic/resilient portions or springs 930 need not necessarily be mounted to the support base 22, but may alternatively be mounted to the vertical support 910 or to other portions of the support structure 904. Additionally, it should be understood that the flexibly elastic/resilient portions or springs 930 need not necessarily be mounted in a vertical orientation, but may instead be mounted in a horizontal or angled orientation. If the flexibly elastic/resilient portions or springs 930 are mounted in a horizontal orientation, they may be integrated into the support base 22. Additionally, the flexibly elastic/resilient portions or springs 930 may be integrated with other portions of the exercise device 900, including the vertical support column 160 and/or the support structure 904. Additionally, although the load members 906*a*, 906*b* are illustrated as including rings 934, other gripping devices are also contemplated for manual grasping by the user, including various types and configurations of handles, including devices configured similar to the ends of a jump rope.

Referring not to FIGS. 14-19, shown therein is the exercise device 1000 including the lower body base unit 20 and the upper body unit 1002. As indicated above, the lower body base unit 20 is configured similar or identical to the exercise device 20 illustrated and described above for providing a workout of the lower body. The upper body unit 1002 is configured to provide a simultaneous workout of the upper body, and is generally comprised of a support structure 1004, a first load member 1006, and a second load member 1008.

In the illustrated embodiment, the support structure 1004 generally includes a U-shaped support base 1010, a vertical support column 1012 extending from a central region of the U-shaped support base 1010, and a horizontal support 1014 extending transversely from the vertical support 1012. The support structure 1004 may also be provided with angled gussets or ribs 1016 extending from the legs of the U-shaped support base 1010 to the vertical support column 1012 to provide additional strength and stability to the support structure 1004. In one embodiment, the support structure 1004 may be formed of tube steel, and may include tube portions that are assembled together and interconnected to form a rigid support structure. However, others types and configurations of the support structure 1004 are also contemplated as would occur to one of skill in the art. In one embodiment, the support structure 1004 is a stand-alone structure that need not necessarily be connected or attached to the lower body base unit 20. In the illustrated embodiment, the lower body base unit 20 is positioned within the inner region of the U-shaped support base 1010, with the vertical support column 1012 extending generally parallel with the vertical column 160 of the lower body base unit 20. However, in other embodiments, the support structure 1004 may be attached or connected to the base unit 20.

In the illustrated embodiment, the lower body base unit 20 includes a number of protective panels 1018 that extend vertically about the outer perimeter of the support base 22 and the upper support surface 105 to prevent the user from inadvertently or unintentionally kicking or contacting the position sensor assembly 24 and/or the adjustment mechanism 26 to prevent damage to these devices or injury to the user. The protective panels 1018 are formed of a transparent or translucent material that allows for the transmission of light therethrough to avoid interfering with the sensing capabilities of the position sensor assembly 26. The protective panels 1018 may be supported by the support base 22, the hand rails 500*a*, 500*b*, and/or the vertical column 160. In other respects, the lower body base unit 20 is configured similar or identical to the exercise device 20 illustrated and described above.

In the illustrated embodiment, the load members 1006 and 1008 are operatively coupled to and supported by the support structure 1004, and more specifically the vertical support column 1012. As will be discussed below, the load members 1006 and 1008 each include at least one elastic/resilient resistance element that is capable of being elastically deformed or transitioned from an initial state in response to exertion of an applied force, and which resiliently reforms or transitions back toward the initial state upon release or reduction of the applied force.

Figure 16:
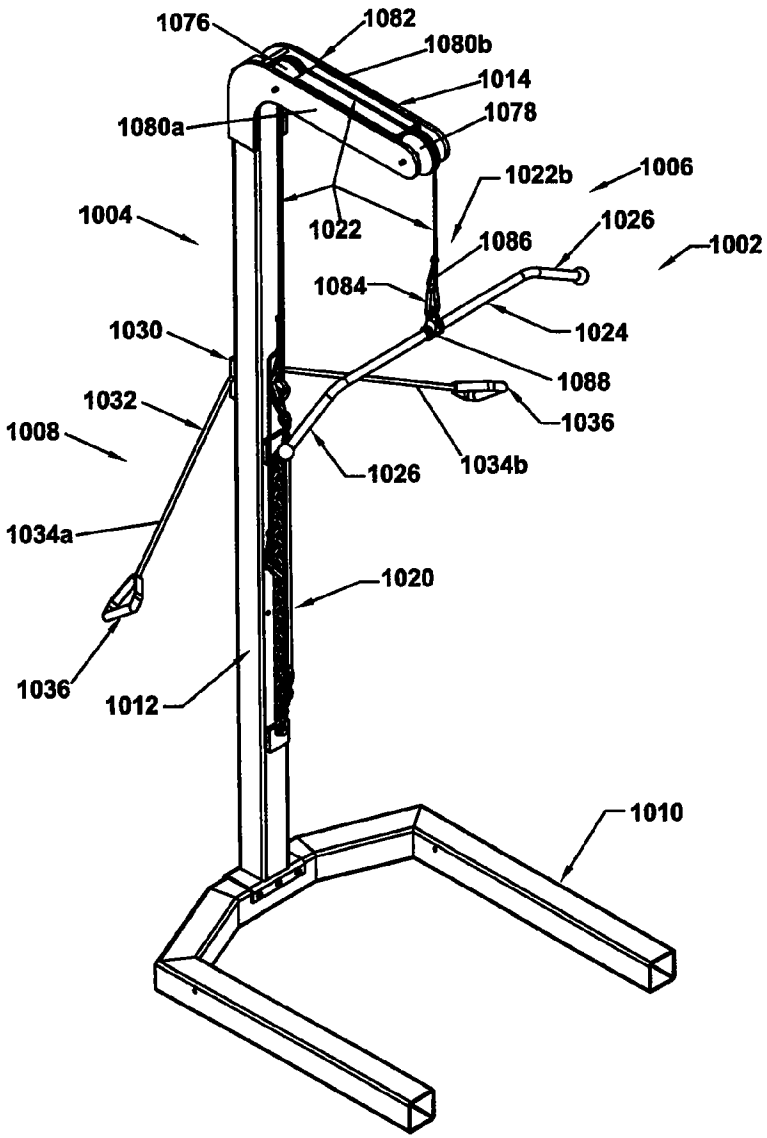
FIG. 16 is a rear elevational perspective view of an upper body unit for use in association with the exercise device illustrated in FIG. 14 to provide an upper body workout.
Figure 17:
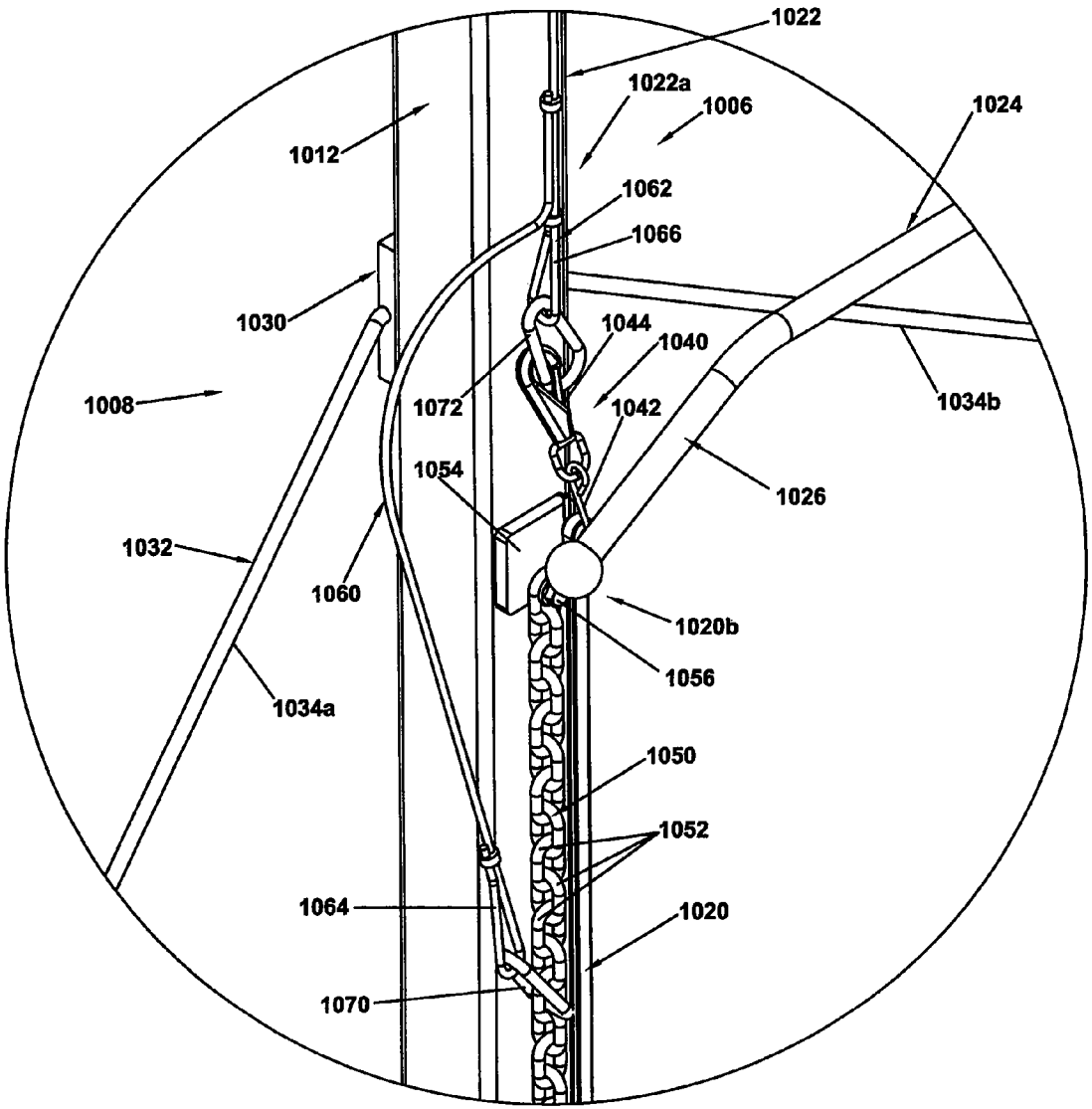
FIG. 17 is an enlarged view of a portion of the upper body unit illustrated in FIG. 16, showing a flexibly elastic and resilient element attached to an inelastic cable element.
Figure 18:
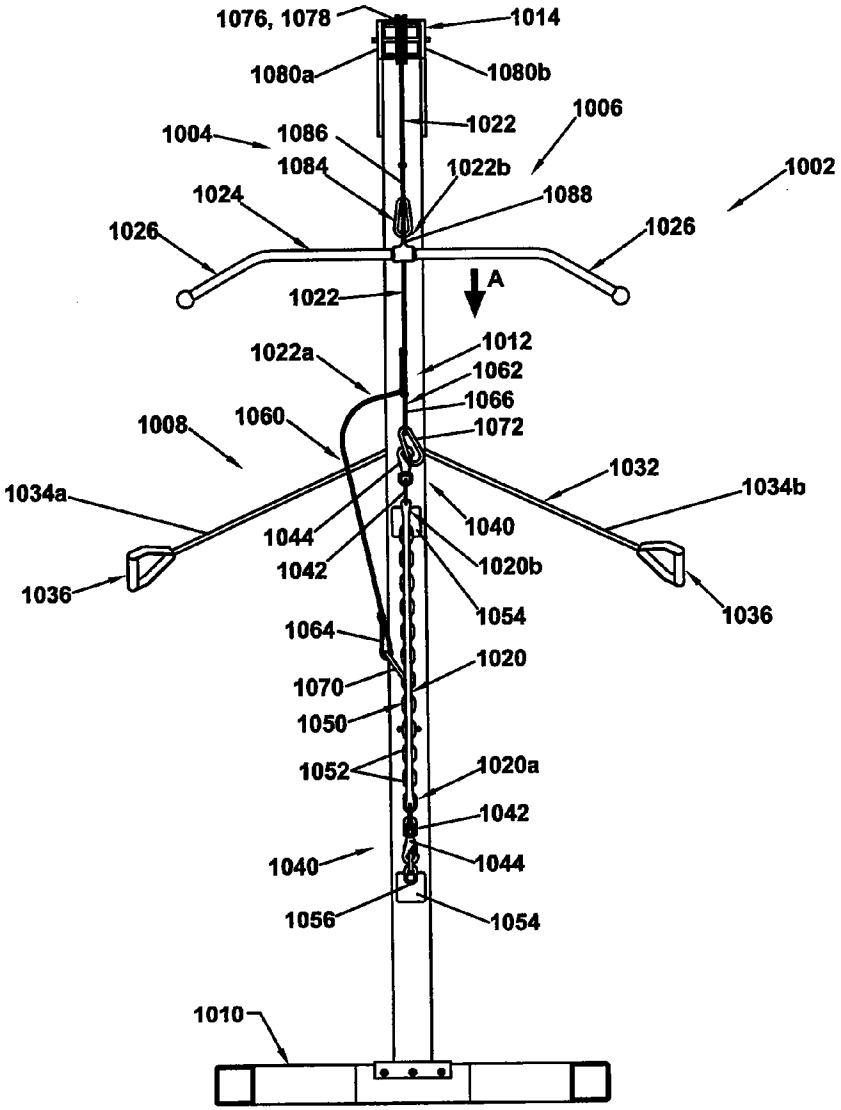
FIG. 18 is a rear elevational view of the upper body unit illustrated in FIG. 16, with the inelastic cable element shown in a slackened state, and with the flexibly elastic and resilient element shown in an initial state.

Referring now to FIGS. 16-18, in the illustrated embodiment of the invention, the first load member 1006 generally includes a flexibly elastic/resilient element 1020, a substantially inelastic cable element 1022, and an actuator element or bar 1024 including a pair of gripping portions 1026. As will be discussed in greater detail below, a first end of the flexibly elastic/resilient element 1020 is connected to the vertical support column 1012. Additionally, the inelastic cable element 1022 includes a first end attached to a mid-portion of the actuator bar 1024, and an opposite second end having a first end portion connected to the vertical support column 1012 and a second end portion connected to the free end of the elastic/resilient element 1020.

The gripping portions 1026 associated with the actuator bar 1024 are laterally offset from one another by a distance d (FIG. 14), which preferably corresponds to a distance equal to or somewhat greater than the average spacing between a user's arms or shoulders. However, other distances d are also contemplated. Additionally, the load member 1006 is preferably configured such that the gripping portions 1026 of the actuator bar 1024 are positioned at a height h (FIG. 14) above the upper support surface 105 of the support base 22, which preferably corresponds to a height of the user's hands when the user's arms are in a vertically extended position. However, other heights h are also contemplated. Additionally, as will be discussed below the load member 1006 and the vertical support column 1012 include features that allow for adjustment to the height h of the gripping portions 1026 above the upper support surface 105 to accommodate users having different heights or vertical reaches. In the illustrated embodiment, these adjustment features are manually adjustable. However, automatic adjustment features are also contemplated, with adjustment to the height h of the gripping portions 1026 being automated and controlled via the control panel 28 and an actuator, such as, for example, an electric, hydraulic or pneumatic motor, a hydraulic or pneumatic cylinder, or any other rotary or linear actuator that would occur to one of skill in the art. In the illustrated embodiment, the distance d between the gripping portions 1026 is fixed. However, the actuator bar 1024 may be modified to provide adjustment to the distance d between the gripping portions 1026 to accommodate users having different physical attributes.

In the illustrated embodiment, the second load member 1008 generally includes a mounting element 1030, a flexibly elastic/resilient element 1032 including first and second portions 1034*a*, 1034*b*, and a pair of gripping portions 1036 attached to the ends of the first and second portions 1034*a*, 1034*b*. As will be discussed in greater detail below, the mounting element 1030 is operatively connected to the vertical support column 1012, and the flexibly elastic/resilient element 1032 is attached to and extends from the mounting element 1030. The lengths of the first and second portions 1034*a*, 1034*b* of the flexibly elastic/resilient element 1032 are preferably selected such that the gripping portions 1036 are laterally offset or spread apart from one another by a distance which preferably corresponds to a distance equal to or somewhat greater than the average spacing between a user's arms or shoulders. Additionally, the mounting element 1030 is preferably coupled to the vertical support column 1012 such that the gripping portions 1036 are positioned at a height above the upper support surface 105 of the support base 22, which preferably corresponds to a height of the user's hands. However, other heights are also contemplated. Additionally, as will be discussed below, the load member 1008 and the vertical support column 1012 include features that allow for adjustment to the height of the gripping portions 1036 above the upper support surface 105 to accommodate users having different heights or reaches. In the illustrated embodiment, these adjustment features are manually adjustable. However, automatic adjustment features are also contemplated.

Referring collectively to FIGS. 16-19, shown therein are further details and features of the upper body unit 1002 associated with the exercise device 1000, with the lower body base unit 20 removed for clarity. As indicated above, the upper body unit 1002 is generally comprised of a support structure 1004, a first load member 1006, and a second load member 1008. Additionally, the support structure 1004 generally includes a U-shaped support base 1010, a vertical support column 1012, and a horizontal support 1014.

As also indicated above, the first load member 1006 generally includes a flexibly elastic/resilient element 1020, a substantially inelastic cable element 1022, and an actuator bar 1024 including gripping portions 1026 at either end of the actuator bar 1024. As shown most clearly in FIGS. 17-19, the flexibly elastic/resilient element 1020 includes a first end portion 1020*a* that is operatively coupled to the vertical support column 1012, and a second end portion 1020*b* that is operatively coupled to the inelastic cable element 1022. In the illustrated embodiment, the flexibly elastic/resilient element 1020 is configured as a flexible or supple band or strap that is formed of an elastomeric material capable of being stretched and elastically deformed from an initial state to an elastically deformed state upon exertion of an applied force, and which is also capable of resiliently reforming and returning toward the initial state upon release or reduction of the applied force. Such material include, for example, rubber or rubber-like materials, latex, polymeric or plastic materials, composite materials, metallic materials, shape-memory materials, including polymer-based and metallic-based shape-memory materials, or any other suitable elastic/resilient material that would occur to one of skill in the art.

In the illustrated embodiment, each end portion 1020*a*, 1020*b* of the band 1020 is provided with a connection device 1040. As most clearly shown in FIG. 17, in one embodiment, the connection device 1040 includes a link 1042 attached to each end portion 1020*a*, 1020*b* of the band 1020, and a clip 1044 connected to the link 1042. The connection link 1040 includes a first end loop (not shown) which is inserted through an opening in either end portion 1020*a*, 1020*b* of the band 1020, and a second end loop which receives a looped portion of the connection clip 1044. The connection clip 1044 includes a spring-loaded wall which may be inwardly compressed to allow for insertion or removal of a device into the interior of the connection clip 1044. The connection clip 1044 therefore provides a quick and simple arrangement for releasable connecting either end of the band 1020 to other structures or devices. Although a particular type of connection device 1040 has been illustrated and described for use with the band 1020, it should be understood that other types of connection devices and connection arrangements are also contemplated.

In one embodiment of the invention, the vertical support column 1012 is provided with multiple attachment or connection locations for coupling the end portion 1020*a* of the band 1020 and an end portion of the inelastic cable element 1022 to the vertical support column 1012. In the illustrated embodiment, a chain 1050 is provided which includes multiple chain links 1052. The chain 1050 is attached to the vertical support column 1012 by way of upper and lower mounting plates 1054. The mounting plates 1054 may be welded or fastened to the vertical support column 1012, and the chain 1050 may be attached connected to the end plates 1054 by way of a bolt or fastener 1056 which extends through the links 1052 at either end of the chain 1050. As should be appreciated, the individual chain links 1052 provide multiple attachment or connection points along a length of the vertical support column 1012. Although a chain 1050 has been illustrated and described for providing multiple attachment or connection locations, it should be understood that other devices and arrangements are also contemplated as would occur to one of ordinary skill in the art.

Figure 19:
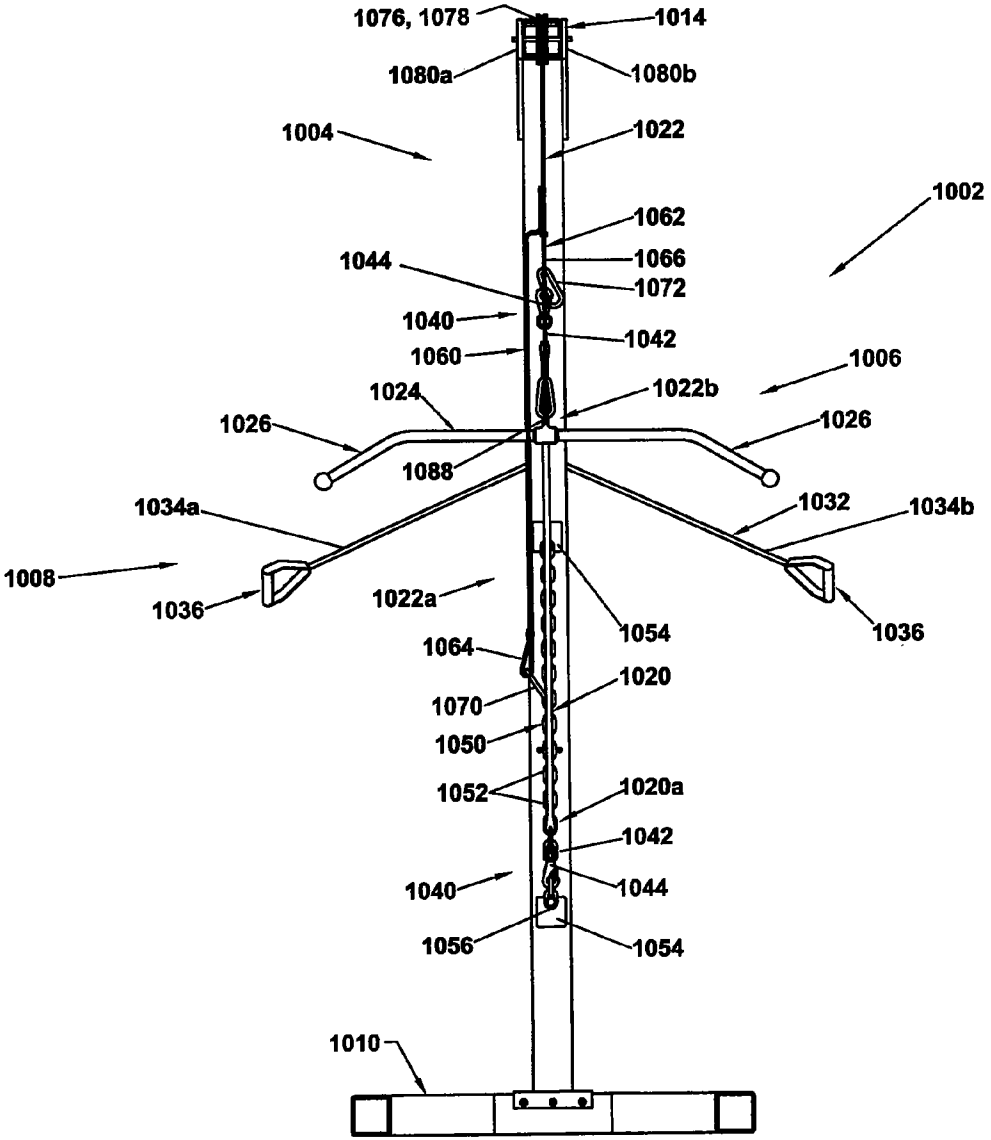
FIG. 19 is a rear elevational view of the upper body unit illustrated in FIG. 16, with the inelastic cable element shown in a taut state, and with the flexibly elastic and resilient element shown in an elastically deformed or stretched state.

Referring to FIGS. 17-19, the inelastic cable element 1022 includes a first end portion 1022*a* connected to the vertical support column 1012 via the connection or attachment points provided by the links 1052 of the chain 1050, and a second end portion 1022*b* that is operatively coupled to the actuator bar 1024. In the illustrated embodiment, the inelastic cable element 1022 is configured as a metallic cable that is substantially inelastic to prevent stretching or deformation when pulled to a taut state. In one embodiment, the inelastic cable element 1022 is configured as a multi-filament cable, such as, for example, an aircraft cable. The inelastic cable element 1022 may include a protective sheath or covering to minimize wear and prolong the useful life of the cable element 1022 and the devices which come into contact the cable element 1022. However, it should be understood that other types of substantially inelastic elements are also contemplated for use in association with the present invention, including non-metallic cables or other elongate elements, such as, for example, belts, ropes, and chains, or any other suitable elongate element that would occur to one of skill in the art.

As shown most clearly in FIG. 17, the end portion 1022*a* of the inelastic cable element 1022 includes a first cable segment 1060 that is connected or attached to one of the links 1052 of the chain 1050, and a second cable segment 1062 that is connected or attached to the end portion 1020*b* of the flexibly elastic/resilient band 1020. As shown in FIGS. 17 and 18, the first cable segment 1060 is shown in a slacked or non-tensioned state. However, when the user pulls on the gripping portions 1026 of the actuator bar 1024, the applied pulling force is transmitted through the inelastic cable 1022 and stretches the flexibly elastic/resilient band 1020. Although the flexibly elastic/resilient band 1020 provides a level of resistance to the pulling force applied to the gripping portions 1026, the actuator bar 1024 is allowed to be displaced in the direction of arrow A. As the actuator bar 1024 is displaced in the direction of arrow A and the flexibly elastic/resilient band 1020 continues to stretch, the slack in the first cable segment 1060 is taken out until the first cable segment 1060 is transitioned to a taut or tensioned state. (FIG. 19). Due to the inelastic nature of the cable element 1022 and the taut state of the cable segment 1060, any additional pulling force applied to the gripping portions 1026 will not result in any further stretching of the elastic/resilient band 1020 or any further displacement of the actuator bar 1024.

In the illustrated embodiment, the first and second segments 1060 and 1062 of the cable 1022 are formed as separate cables that are interconnected or joined together via a number of clamps or bands. However, in other embodiments, the first and second cable segments 1060 and 1062 may be provided by a single portion of the inelastic cable 1022. For example, the second segment 1062 of the cable 1022 may be provided as a looped portion of the cable 1022. Additionally, an end portion of the first cable segment 1060 is looped back on itself to form an end loop 1064 which in maintained by a number of clamps or bands. Similarly, an end portion of the second cable segment 1062 is looped back on itself to form an end loop 1066 which in maintained by a number of clamps or bands. In the illustrated embodiment, the first cable segment 1060 is coupled to the vertical support column 1012 by a connection clip 1070 that passes through the end loop 1064 and a selected one of the links 1052 of the chain 1050. The connection clip 1070 may be configured similar to the connection clip 1044 described above, or may take on other configurations. Additionally, the second cable segment 1062 is coupled to the end portion 1020*b* of the flexibly elastic/resilient band 1020 by a connection link 1072 that passes through the end loop 1066 and the inner region of the connection clip 1044. However, it should be understood that other types of connection devices and connection arrangements are also contemplated for coupling of the end portion 1022*a* of the cable 1022 to the vertical support column 1012 and the flexibly elastic/resilient band 1020.

As shown in FIGS. 16, 18 and 19, the inelastic cable element 1022 runs along the upper portion of the vertical support column 1012 and is wrapped around a pair of pulleys/sheaves or eyelets 1076, 1078 mounted to the horizontal support 1014. In the illustrated embodiment, the horizontal support 1014 includes a pair of spaced apart plates 1080*a*, 1080*b* which define a yoke 1082 within which the pulleys/sheaves 1076, 1078 are mounted. The end portion 1022*b* of inelastic cable element 1022 is coupled to a mid-portion or central region of the actuator bar 1024 by way of a connection link 1084 which passes through an end loop 1086 formed by the end portion 1022*b* of the cable 1022 and an opening defined by a flange or eyelet 1088 extending from a mid-portion of the actuator bar 1024. As indicated above, the actuator bar 1024 includes a pair of gripping portions 1026 arranged at either end of the actuator bar 1024. In the illustrated embodiment, the gripping portions 1026 are configured as handles or bars which are angled downwardly relative to the mid-portion of the actuator bar 1024. The ends of the handles are each provided with a spherical-shaped ball to inhibit the user's hands from sliding off of the gripping portions 1026. Although the gripping portions 1026 are illustrated and described as having a particular configuration, it should be understood that other types and configurations of gripping devices are also contemplated for manual grasping by the user, including rings or various types of handles that would occur to one of skill in the art.

Figure 15A:
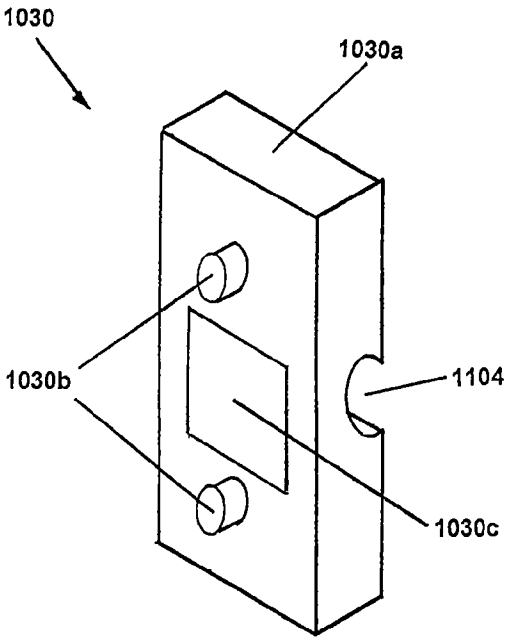
FIG. 15A is a schematic perspective view of an exemplary embodiment of a mounting element.
Figure 15:
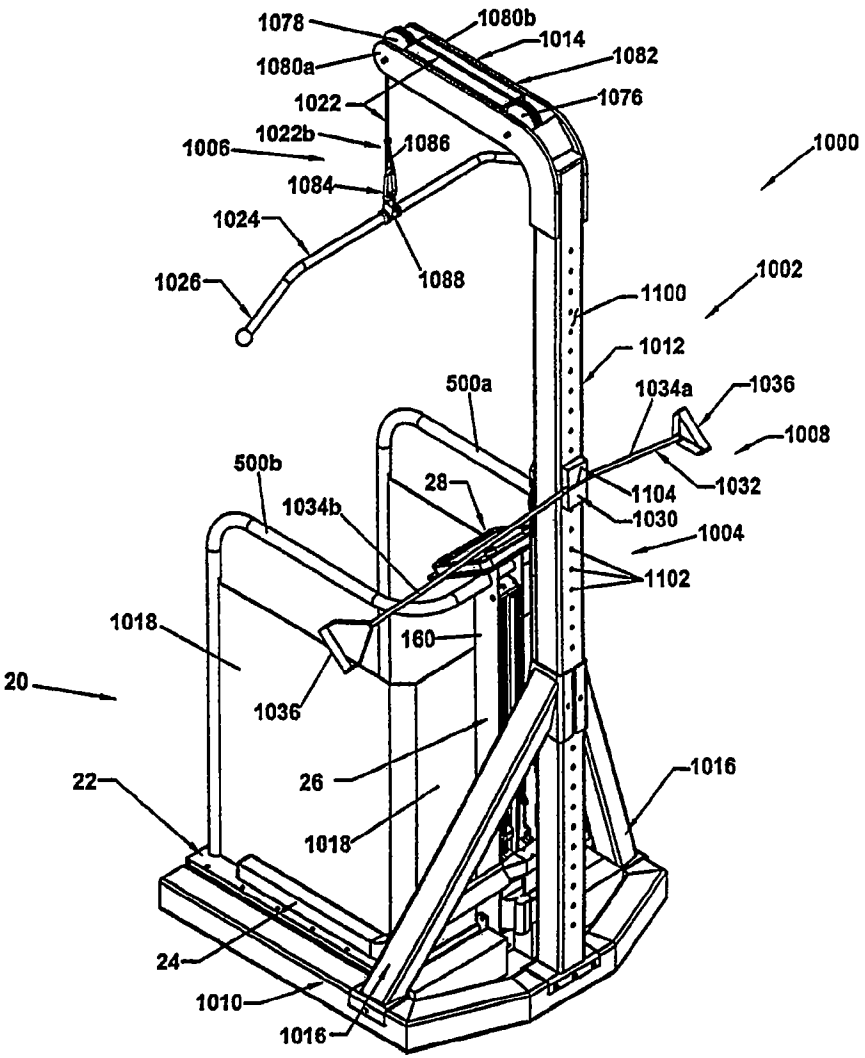
FIG. 15 is a front elevational perspective view of the exercise device illustrated in FIG. 14.

As indicated above, the second load member 1008 generally includes a mounting element 1030, a flexibly elastic/resilient element 1032 including first and second portions 1034*a*, 1034*b*, and a pair of gripping portions 1036. The mounting element 1030 is operatively coupled to the vertical support column 1012, the flexibly elastic/resilient element 1032 is attached to and extends from the mounting element 1030, and the gripping portions 1036 are attached to each end of the flexibly elastic/resilient element 1032. As shown in FIGS. 15 and 15A, in the illustrated embodiment, the mounting element 1030 is configured as a plate or block 1030*a* that is releasably engagable to a generally flat mounting surface 1100 defined by the vertical support column 1012. The mounting surface 1100 may be provided with a number of openings or apertures 1102 positioned at multiple vertical locations along the height of the vertical support column 1012. The openings or apertures 1102 are sized to receive pins or protrusions 1030*b* (schematically-depicted in FIG. 15A) extending from the mounting plate 1030 to releasably attach the mounting plate 1030 to the vertical support column 1012 at a select height above the upper support surface 105 of the support base 22. In order to maintain the mounting plate 1030 in engagement with the vertical support column 1012, the mounting plate 1030 may be provided with a magnet 1030*c* (schematically-depicted in FIG. 15A) with at least the wall of the vertical support column 1012 defining the mounting surface 1100 formed of steel to magnetically couple the mounting plate 1030 to the vertical support column 1012. The mounting plate 1030 may also be provided with a passage 1104 (schematically-depicted in FIG. 15A) extending therethrough in a side-to-side direction and sized to receive the flexibly elastic/resilient element 1032 therein. The passage 1104 may be provided with an open back to facilitate lateral insertion of the flexibly elastic/resilient element 1032 into the passage 1104 to attach the flexibly elastic/resilient element 1032 to the mounting plate.

In one embodiment, the flexibly elastic/resilient element 1032 is provided as a single-piece strap or strand, with the first and second portions 1034*a*, 1034*b* of the strand extending from either side of the mounting plate 1030. However, it should be understood that the flexibly elastic/resilient element 1032 may be provided as separate pieces which define first and second strand portions 1034*a*, 1034*b*. In the illustrated embodiment, the flexibly elastic/resilient element 1032 is configured as a flexible or supple tube or strand formed of an elastomeric material that is capable of being stretched and elastically deformed from an initial state to an elastically deformed state upon exertion of an applied force, and which is also capable of resiliently reforming and returning toward the initial state upon release or reduction of the applied force. The flexibly elastic/resilient element 1032 may be formed of any material that is capable of being elastically deformed from an initial state to a deformed state, and resiliently reformed back toward the initial state. Such materials include, for example, rubber or rubber-like materials, latex materials, polymeric or plastic materials, composite materials, metallic materials, shape-memory materials, including polymer-based and metallic-based shape-memory materials, or any other suitable elastic/resilient material that would occur to one of skill in the art. In the illustrated embodiment, the gripping portions 1036 have a ring configuration. However, other gripping devices are also contemplated for manual grasping by the user, including various types and configurations of handles, including devices configured similar to the ends of a jump rope.

Having described the elements and features associated with the upper body unit 1002 of the exercise device 1000, reference will now be made to operation and use of the lower body base unit 20 and the load member 1006 of the upper body unit 1002 by the user according to one embodiment of the invention. As discussed in detail above, the lower body base unit 20 includes a support base 22 defining an upper support surface 105, a position sensor assembly 24, and adjustment mechanism 26 for adjusting the vertical position of the position sensor assembly 24, and a control panel 28.

The lower body base unit 20 further includes a plurality of light sources 132 (FIGS. 5-7) which light discrete portions or regions of the upper support surface 105 to elicit a response or activity from the user (i.e., walking, running, jumping, etc.) to provide a workout of the lower body. The control panel 28 is in communication with the plurality of light sources 132 and activates/deactivates the light sources 132 to generate the discrete lighted regions on the support surface 105. In one embodiment, the discrete lighted regions comprise discrete light bands extending across the support surface 105 and offset from one another along an axis, with the control panel 28 communicating with the light sources 132 to sequentially turn the discrete light bands off and on in a direction along the axis to simulate a jump rope passing beneath a user's feet. As the virtual jump rope approaches the user, the user jumps into the air to allow the virtual jump rope to pass beneath the user's feet.

In another embodiment, the discrete lighted regions comprise at least two discrete zones of light, with the first light zone extending over a left half of the support surface 105 and the second light zone extending over a right half of the support surface 105, and with the control panel 28 communicating with the light sources 132 to activate and deactivate the light zones. As the light zones are activated/deactivated, the user is cued or prompted to raise or lower his or her foot corresponding to the activated/deactivated light zone. It should be understood that the control panel 28 may be programmed to activate/deactivate the light sources 132 in a manner which lights other discrete portions or regions of the upper support surface 105 to elicit other user responses or activities to provide a workout of the lower body.

As also discussed above, the position sensor assembly 24 includes at least two position sensors 202 (FIGS. 1-6) having sensing paths that are arranged along a sensing plane relative to the upper support surface 105, and with the control panel 28 communicating with the position sensors 202 to detect the presence of the user along the sensing plane. The position sensor assembly 24 may therefore be used to provide real time feedback to the user to verify the user's performance of various user activities, including walking or running in place, jumping over a virtual jump rope, or any other lower body activity that would occur to one of skill in the art.

While performing an activity on the base unit 20 to work out the lower body, the user may also grasp the gripping portions or handles 1026 of the actuator bar 1024 and exert an applied force, such as a pulling force, onto the actuator bar 1024 to simultaneously work out the upper body. As the user pulls down on the actuator bar 1024 in the direction of arrow A (or in other directions), the applied force is transmitted through the inelastic cable 1022, which in turn stretches and elastically deforms the elastic/resilient band 1020. Upon release or reduction of the applied force to the gripping portions 1026, the elastic/resilient band 1020 resiliently reforms and returns toward the initial state. As should be appreciated, as the user progressively applies a pulling force onto the gripping portions 1026, the elastic/resilient band 1020 continues to stretch and resistance to the applied pulling force correspondingly increases. In other words, the resistive force generated by the elastic/resilient band 1020 increases as the user continues to pull down on the gripping portions 1026. Additionally, as the pulling force is applied to the gripping portions 1026, the elastic/resilient band 1020 is stretched from a first initial length $l_1$ to a second length $l_2$, which permits displacement of the actuator bar 1024 in the direction of arrow A or in other directions to the position shown in FIG. 19. Upon release or reduction of the pulling force on the gripping portions 1026, the elastic/resilient band 1020 resiliently reforms and returns toward the first initial length $l_1$, which in turn displaces the actuator bar 1024 in an upward direction opposite arrow A to the initial position shown in FIG. 18.

As shown most clearly in FIG. 17, when the elastic/resilient band 1022 is in the initial, non-stretched state (with the actuator bar 1024 in the initial position shown in FIG. 18), the cable segment 1060 of the inelastic cable element 1022 is in a slackened or non-tensioned state. In the slackened or non-tensioned state, the cable segment 1060 permits stretching and elastic deformation of the band 1020 in response to application of a pulling force onto the gripping portions 1026. Stretching of the band 1020 allows displacement of the actuator bar 1024 in the direction of arrow A, which in turn allows downward displacement of the user's hands and arms as the user applies a downward force onto the gripping portions 1026. Progressively increasing the pulling force applied to the gripping portions 1026 continues to stretch the band 1020, which results in removal of the slack from the cable segment 1060. Once the slack in the cable segment is completely removed, the cable segment 1060 is transitioned to a tensioned or taut state, which prevents further stretching and elastic deformation of the band 1020. The cable segment 1060 therefore functions as a blocking element to limit stretching and elastic deformation of the band 1020 to a predetermined level. The cable segment 1060 also prevents overstretching of the band 1020, which could otherwise result in failure of the band 1020 and potential injury to the user.

When the cable segment 1060 is in the slackened or non-taut state, application of a pulling force onto the gripping portions 1026 allows stretching and elastic deformation of the band 1020. However, once the cable segment is transitioned to the taut state, the cable segment 1060 will prevent further stretching and elastic deformation of the band 1020 beyond the predetermined level of deformation. At this point, any additional pulling force applied to the gripping portions 1026 will not result in further displacement of the actuator bar 1024, and the user's hands and arms will be maintained in position, even as the user continues to apply a downward pulling force onto the gripping portions 1026. As a result, the user may pull himself/herself off of the support surface 105 of the support base 22 while performing an exercise activity. In this manner, the weight of the user provides loading or resistance to workout the user's upper body, which is similar to performing chin-ups or other pull up exercises.

Although the cable segment 1060 has been illustrated and described as a blocking element to limit stretching and elastic deformation of the band 1020 to a predetermined level, it should be understood that other features may be included to limit stretching and elastic deformation of the band 1020 to a predetermined level. For example, a block could be attached to the vertical support column 1012 or the horizontal support 1014, and a stop element could be attached to the inelastic cable 1022. As should be appreciated, application of a pulling force onto the gripping portions 1026 would allow stretching of the band 1020 and displacement of the actuator bar 1024 until the stop element abuts the block attached to the vertical support column 1012 or the horizontal support 1014. Such abutment would in turn prevent further stretching and elastic deformation of the band 1020, and thereby limit stretching and elastic deformation of the band 1020 to a predetermined level. As should also be appreciated, the position of the block and/or the position of the stop element could be varied to corresponding vary the point at which the stop element abuts the block, which would in turn adjust the predetermined level of stretching and elastic deformation of the band 1020.

Figure 14:
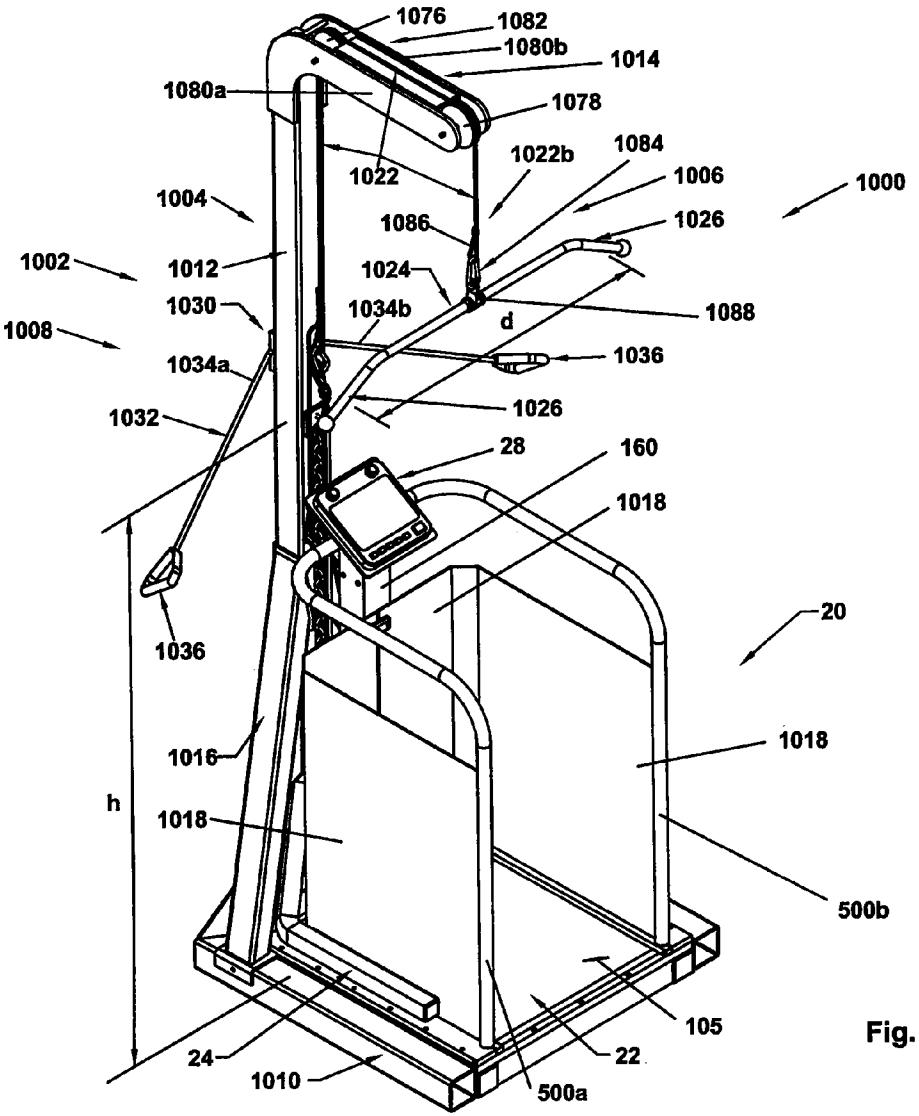
FIG. 14 is a rear elevational perspective view of an exercise device according to yet another form of the present invention.

As indicated above, the links 1052 of the chain 1050 provide multiple points of attachment for connecting the end portion **1022*a* of the band 1020 and the free end of the cable segment 1060 to the vertical support column 1012. As should be appreciated, connection of the end portion 1022*a* of the band 1020 to a select one of the chain links 1052 correspondingly positions the gripping portions 1026 of the actuator bar 1024 at a select height h above the support surface 105 (FIG. 14). As should also be appreciated, the height h of the gripping portions 1026 may be varied by connecting the end portion 1022*a* of the band 1020 to a different chain link 1052. In this manner, the height h of the gripping portions 1026 may be selected to correspond to the particular height or vertical reach of the user. Additionally, connection of the free end of the cable segment 1060 to a select one of the chain links 1052 correspondingly determines the lowest position or height of the gripping portions 1026 of the actuator bar 1024 when the cable segment 1060 is transitioned to the tensioned or taut state shown in FIG. 19. As should be appreciated, the lowest position of the gripping portions 1026 may be varied by connecting the free end of the cable segment 1060 to a different chain link 1052**.

Although the illustrated embodiment of the upper body unit 1002 utilizes a single elastic/resilient element 1020, it should be understood that two or more elastic/resilient elements 1020 may be coupled between the vertical support column 1012 and the inelastic cable 1022 to provide variable levels of resistance to the pulling force applied to the gripping portions 1026 by the user. Additionally, it should be understood that a set of elastic/resilient elements 1020 having different levels of elasticity may be provided for use in association with the upper body unit 1002, with one of the elastic/resilient elements 1020 selected to provide a particular level of resistance to the pulling force applied to the gripping portions 1026. Furthermore, although the elastic/resilient element 1020 illustrated and described above is configured as a flexible band or strap, it should be understood that other types of elastic/resilient elements are also contemplated for use in association with the upper body unit 1002. For example, in one alternative embodiment, the elastic/resilient element 1020 may be configured as a spring, such as a coil spring, that is expanded upon application of a pulling force onto the gripping portions 1026. In another alternative embodiment, the elastic/resilient element 1020 may be configured as a flexible rod or bar that is bent or flexed to an arcuate configuration upon application of a pulling force onto the gripping portions 1026. In a further alternative embodiment, the elastic/resilient element 1020 may be configured as a piston-type element which provides resistance via an increase in fluid or air pressure as the user exerts a pulling force onto the gripping portions 1026, with the increased fluid or air pressure causing the resistance elements to return toward an initial state upon release or reduction of the pulling force. In another alternative embodiment, one or more weights may be attached to the cable 1022 to provide gravitational resistance to a pulling force applied to the gripping portions 1026. If weights are used, a guide structure is preferably provided to guide the weights along a predetermined vertical path.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An assembly for coupling an exercise element to an exercise device comprising a support base and a support member, the assembly comprising:

a mounting element comprising a block, the block comprising:

a surface, a plurality of protrusions extending from the surface, and a magnet, wherein the block is configured to be coupled to the exercise element, wherein the support member is stationary relative to the support base and comprises a plurality of openings, wherein the protrusions are configured to engage the openings of the support member, and the magnet is configured to magnetically couple the mounting element to the support member; and wherein the mounting element is configured to be coupled to the support member such that the mounting element is vertically-fixed during use of the exercise element.

2. The assembly of claim 1, wherein the support member is a support column, and the mounting element is configured to releasably couple the exercise element to the support column in a vertically adjustable manner.

3. The assembly of claim 1, wherein the protrusions are positioned on the block such that the exercise element extends in a direction orthogonal with respect to the support member when the mounting element is coupled to the support member.

4. The assembly of claim 1, wherein the block comprises a passage extending through the mounting element.

5. An assembly for working out the upper body of a user, the assembly comprising:

a support base;

a support member coupled to the support base and comprising a vertical support column having a plurality of openings, the support member being stationary relative to the support base;

a mounting element comprising a block, the block comprising:

a surface, a plurality of protrusions extending from the surface, and a magnet; and an exercise element configured to facilitate working out the upper body of the user, wherein the exercise element is coupled to the mounting element, and wherein the protrusions engage the openings of the support column, and the magnet magnetically couples the mounting element to the support column such that the mounting element is vertically-fixed during use of the exercise element.

6. The assembly of claim 5, wherein the support base is configured to be supported by one of the ground and another assembly for working out the body of the user.

7. The assembly of claim 5, wherein the mounting element is configured to releasably couple the exercise element to the support column in a vertically adjustable manner.

8. The assembly of claim 5, wherein the protrusions are positioned on the block such that the exercise element extends in a direction orthogonal with respect to the support column.

9. The assembly of claim 5, wherein the mounting element comprises a passage, and the exercise element is coupled to the mounting element via the passage.

10. The assembly of claim 9, wherein the exercise element comprises a flexible, elastic element extending through the passage of the mounting element.

11. The assembly of claim 10, wherein the exercise element comprises gripping portions configured to be grasped by the user.

12. An exercise device for working out the upper and lower body of a user, the device comprising:

a support base;

a lower unit coupled to the support base and configured to facilitate working out the lower body of the user, the lower unit comprising a support surface configured for the user to simulate walking, simulate running, and jumping thereon; and an upper unit configured to facilitate working out the upper body of the user;

the upper unit comprising:

a support member coupled to the support base and comprising a vertical support column having a plurality of openings, the support member being stationary relative to the support base;

a mounting element comprising a block, the block comprising:

a surface, a plurality of protrusions extending from the surface, and a magnet; and an exercise element configured to facilitate working out the upper body of the user, wherein the exercise element is coupled to the mounting element, and wherein the protrusions engage the openings of the support column, and the magnet magnetically couples the mounting element to the support column such that the mounting element is vertically-fixed during use of the exercise element.

13. The device of claim 12, wherein the support base is configured to be supported by one of the ground and the lower unit.

14. The device of claim 12, wherein the mounting element is configured to releasably couple the exercise element to the support column in a vertically adjustable manner.

15. The device of claim 12, wherein the protrusions are positioned on the block such that the exercise element extends in a direction orthogonal with respect to the support column.

16. The device of claim 12, wherein the mounting element comprises a passage, and the exercise element is coupled to the mounting element via the passage.

17. The device of claim 16, wherein the exercise element comprises a flexible, elastic element extending through the passage of the mounting element.

18. The device of claim 17, wherein the exercise element comprises gripping portions configured to be grasped by the user.

19. The device of claim 12, further comprising a plurality of sensors associated with the lower unit, wherein the sensors are configured to detect the presence of the user.

20. The device of claim 12, further comprising a plurality of lights associated with the support surface, wherein the lights are configured to generate lighted regions on the support surface.

* * * * *